US010679562B2

(12) United States Patent
Oh

(10) Patent No.: US 10,679,562 B2
(45) Date of Patent: Jun. 9, 2020

(54) ELECTROLUMINESCENCE DISPLAY

(71) Applicant: LG DISPLAY CO., LTD., Seoul (KR)

(72) Inventor: Zonggun Oh, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/190,289

(22) Filed: Nov. 14, 2018

(65) Prior Publication Data

US 2019/0164492 A1 May 30, 2019

(30) Foreign Application Priority Data

Nov. 24, 2017 (KR) ..... 10-2017-0158696

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2300/0842* (2013.01); *G09G 2310/08* (2013.01); *G09G 2320/0233* (2013.01); *G09G 2330/025* (2013.01); *G09G 2330/06* (2013.01)

(58) Field of Classification Search
CPC ..... G09G 3/3233; G09G 2300/0819; G09G 2320/043; G09G 2330/02; G09G 2320/045; G09G 3/3696; G09G 3/3208–3291
See application file for complete search history.

(56) References Cited

U.S. PATENT DOCUMENTS

2012/0235973 A1* 9/2012 Yoo ..... G09G 3/3233 345/211
2013/0127692 A1* 5/2013 Yoon ..... G09G 3/3258 345/80
2013/0249883 A1* 9/2013 Hwang ..... G09G 3/003 345/212
2015/0229117 A1* 8/2015 Kim ..... H02H 3/08 345/212

FOREIGN PATENT DOCUMENTS

KR 10-2017-0077921 A 7/2017

* cited by examiner

*Primary Examiner* — Sanjiv D. Patel
(74) *Attorney, Agent, or Firm* — Polsinelli PC

(57) ABSTRACT

An electroluminescence display includes a plurality of pixels; a first power line and a second power line, coupled to each of the plurality of pixels respectively to provide a first voltage and a second voltage; and a switching circuit, configured to switch the first voltage and the second voltage between a high level voltage and a low level voltage, respectively.

20 Claims, 20 Drawing Sheets

ELECTROLUMINESCENCE DISPLAY

CROSS-REFERENCE TO RELATED APPLICATION

This application claims the benefit of Korean Patent Application No. 10-2017-0158696 filed on Nov. 24, 2017, the entire contents of which is incorporated herein by reference in its entirety for all purposes as if fully set forth herein.

BACKGROUND

Field of the Disclosure

The present disclosure relates to an electroluminescence display.

Description of the Background

Electroluminescence displays are roughly classified into inorganic light-emitting displays and organic light-emitting displays depending on the material of an emission layer. Of these, an active-matrix organic light emitting display comprises organic light-emitting diodes (hereinafter, "OLED") which emit light themselves, and has the advantages of fast response time, high luminous efficiency, high brightness, and wide viewing angle.

Each pixel of an organic light-emitting display comprises an OLED and a driving element that supplies current to the OLED at a gate-source voltage. The OLED of the organic light-emitting display comprises an anode, a cathode, and an organic compound layer situated between these electrodes. The organic compound layer consists of a hole injection layer (HIL), a hole transport layer (HTL), an emission layer (EML), an electron transport layer (ETL), and an electron injection layer (EIL). When a current flows through the OLED, a hole passing through the hole transport layer HTL and an electron passing through the electron transport layer ETL move to the emission layer EML, forming an exciton. As a result, the emission layer EML generates visible light.

In the organic light-emitting display, an address period during which data is written to pixels and an emission period during which pixels emit light are separated on the time axis. Due to such a driving method, motion blur can be seen on the organic light-emitting display, and peak current makes it susceptible to EMI (electro-magnetic interference).

SUMMARY

A pixel circuit in an electroluminescence display device may comprise a plurality of transistors connected to signal lines. When the voltage of a gate signal applied to the gate of such a transistor changes, kickback may occur due to parasitic capacitance between the gate and source of this transistor. A voltage variation in the transistor due to the kickback may cause a decrease in the gate-source voltage Vgs of a transistor for a driving element. The decrease in the gate-source voltage Vgs of the driving element may reduce the current in the OLED, leading to luminance degradation in pixels. The kickback due to the parasitic capacitance of the transistor may act as a cause of the large differences in luminance depending on the position of the display panel, when the amount of delay in gate signals on the screen varies.

Accordingly, the present disclosure provides an electroluminescence display that can reduce the effect of kickback voltage in a pixel circuit and improve the uniformity of screen luminance.

In one aspect, there is provided an electroluminescence display comprising a first block in which a plurality of pixels are arranged; first and second power lines connected to the pixels in the first block; a first switching circuit that switches the voltage supplied to the first power line between a high-level voltage and a low-level voltage; a second switching circuit that switches the voltage supplied to the second power line between the high-level voltage and the low-level voltage; a second block in which a plurality of pixels are arranged; third and fourth power lines connected to the pixels in the second block; a third switching circuit that switches the voltage supplied to the third power line between the high-level voltage and the low-level voltage; and a fourth switching circuit that switches the voltage supplied to the fourth power line between the high-level voltage and the low-level voltage.

The voltages supplied to the first to fourth power lines swing between the high-level voltage and the low-level voltage.

In another aspect, there is provided an electroluminescence display comprising: multiple blocks, each of which including a plurality of pixels, separate power lines for each of the multiple blocks, and switching circuits for switching voltages on the power lines of each block between a high level voltage and a low level voltage.

BRIEF DESCRIPTION OF THE DRAWINGS

The accompanying drawings, which are included to provide a further understanding of the disclosure and are incorporated in and constitute a part of this specification, illustrate aspects of the disclosure and together with the description serve to explain the principles of the disclosure. In the drawings.

DETAILED DESCRIPTION

Figure 1:
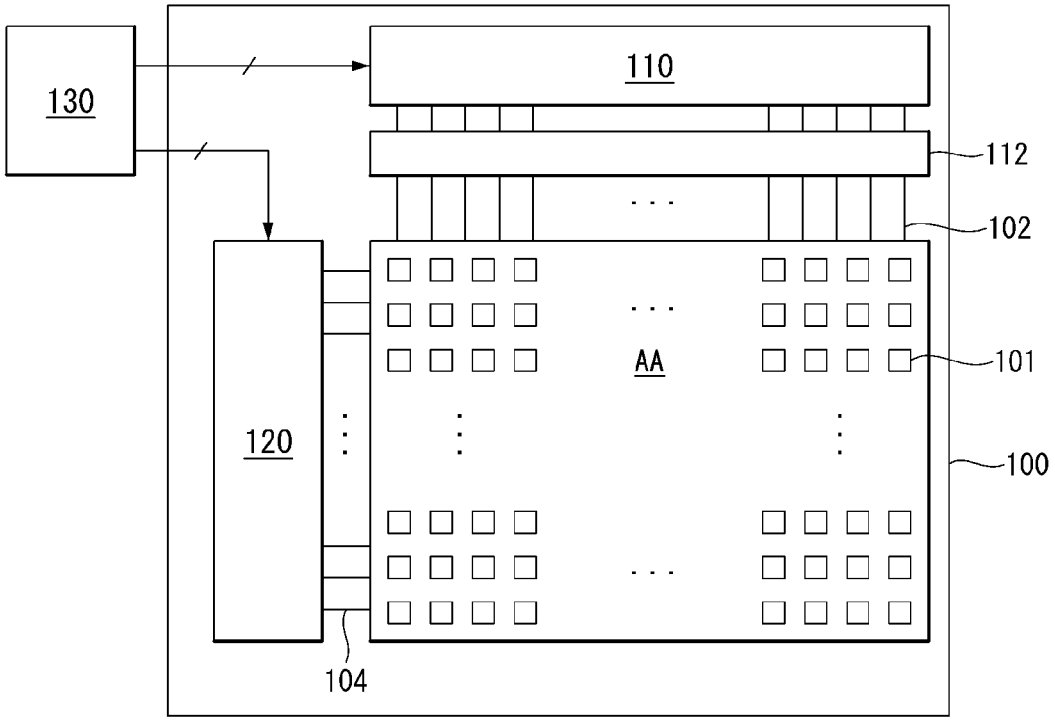
FIG. 1 is a block diagram showing an electroluminescence display according to an exemplary aspect of the present disclosure.

Reference will now be made in detail to aspects of the disclosure, examples of which are illustrated in the accompanying drawings. However, the present disclosure is not limited to aspects disclosed below, and may be implemented in various forms. These aspects are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing aspects of the disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include", "have", "comprised of", etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed there between. In the description of connection relationship, when two components are described as being "connected" or "coupled" with each other, it should be construed as including a case in which the two components are directly connected and a case in which another component is disposed there between.

Figure 4:
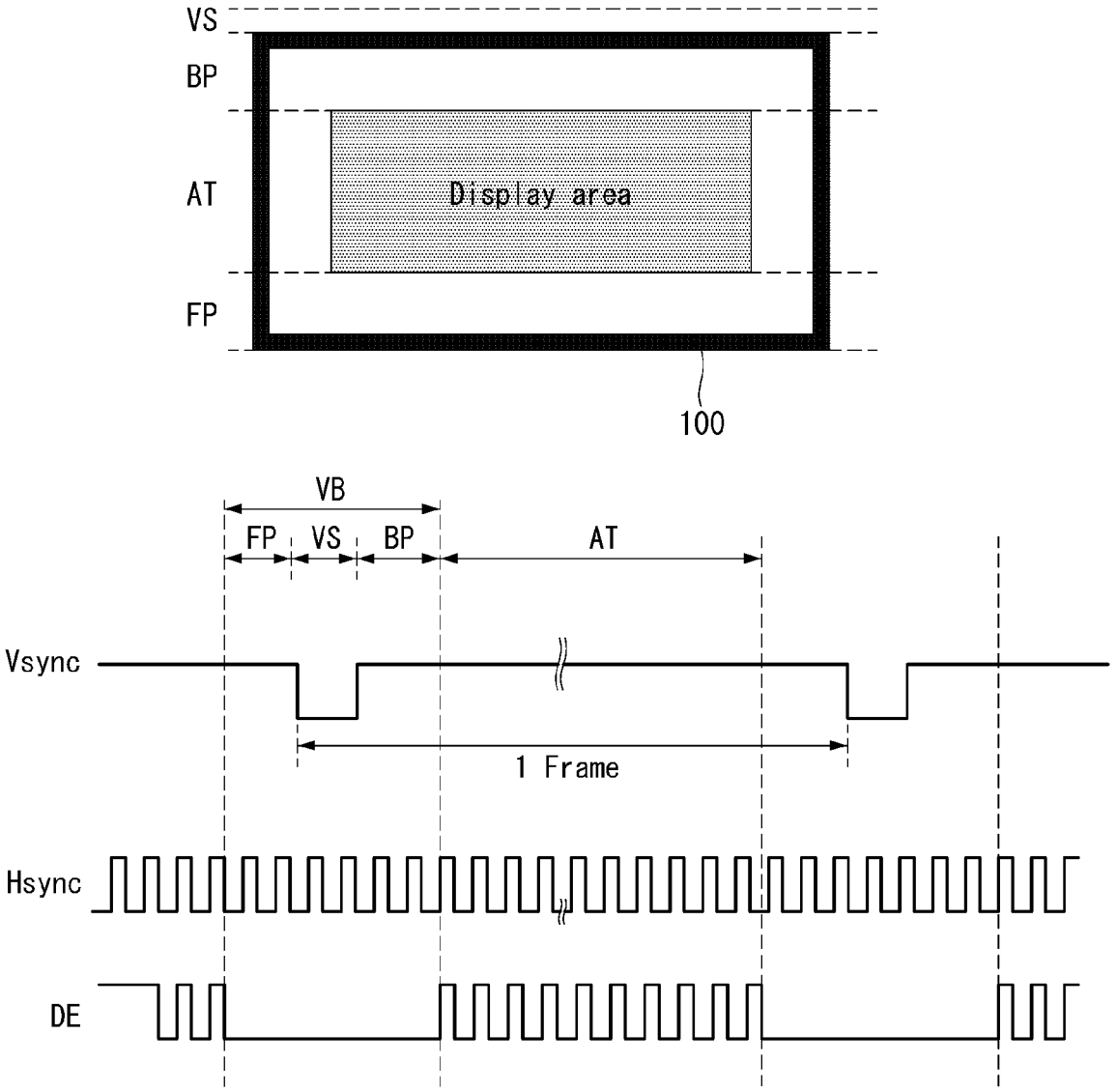
FIG. 4 is a view showing in detail an active period and a vertical blanking interval.

It will be understood that, although the terms first, second, etc., may be used to distinguish one element from another element, the functions or structures of these elements should not be limited by ordinal numbers or terms coming before the elements. For example, ordinal numbers, such as first, second, third, and fourth, coming before elements in a pixel circuit of FIG. 4 are given in the order data lines are sequentially charged through switching elements S1 to S4.

The following exemplary aspects may be combined with one another either partly or wholly, and may technically interact or work together in various ways. The exemplary aspects may be carried out either independently or in association with one another.

In an organic light-emitting display, compensation circuits for compensating for changes in the characteristics of a driving element for driving pixels may be used. The compensation circuits may be divided into internal compensation circuits and external compensation circuits. Using the internal compensation circuit placed in each pixel, the pixel circuit internally and automatically compensates for threshold voltage variations between driving elements by sampling the threshold voltage of the driving elements and adding the threshold voltage to data voltages for pixel data to drive the pixels. The external compensation circuit compensates for changes in the driving characteristics of each pixel by sensing electrical characteristics of the driving elements and modulating pixel data of an input image based on the sensing results. In the following exemplary aspects, the present disclosure will be described, focusing on but not limited to an electroluminescence display using an external compensation circuit.

Hereinafter, various exemplary aspects of the present disclosure will be described in detail with reference to the accompanying drawings. In the following exemplary aspects, an electroluminescence display will be described with respect to an organic light-emitting display comprising organic light-emitting material. However, it should be noted that the technical spirit of the present disclosure is not limited to organic light-emitting displays but can also be applied to inorganic light-emitting displays comprising inorganic light-emitting material.

Figure 2:
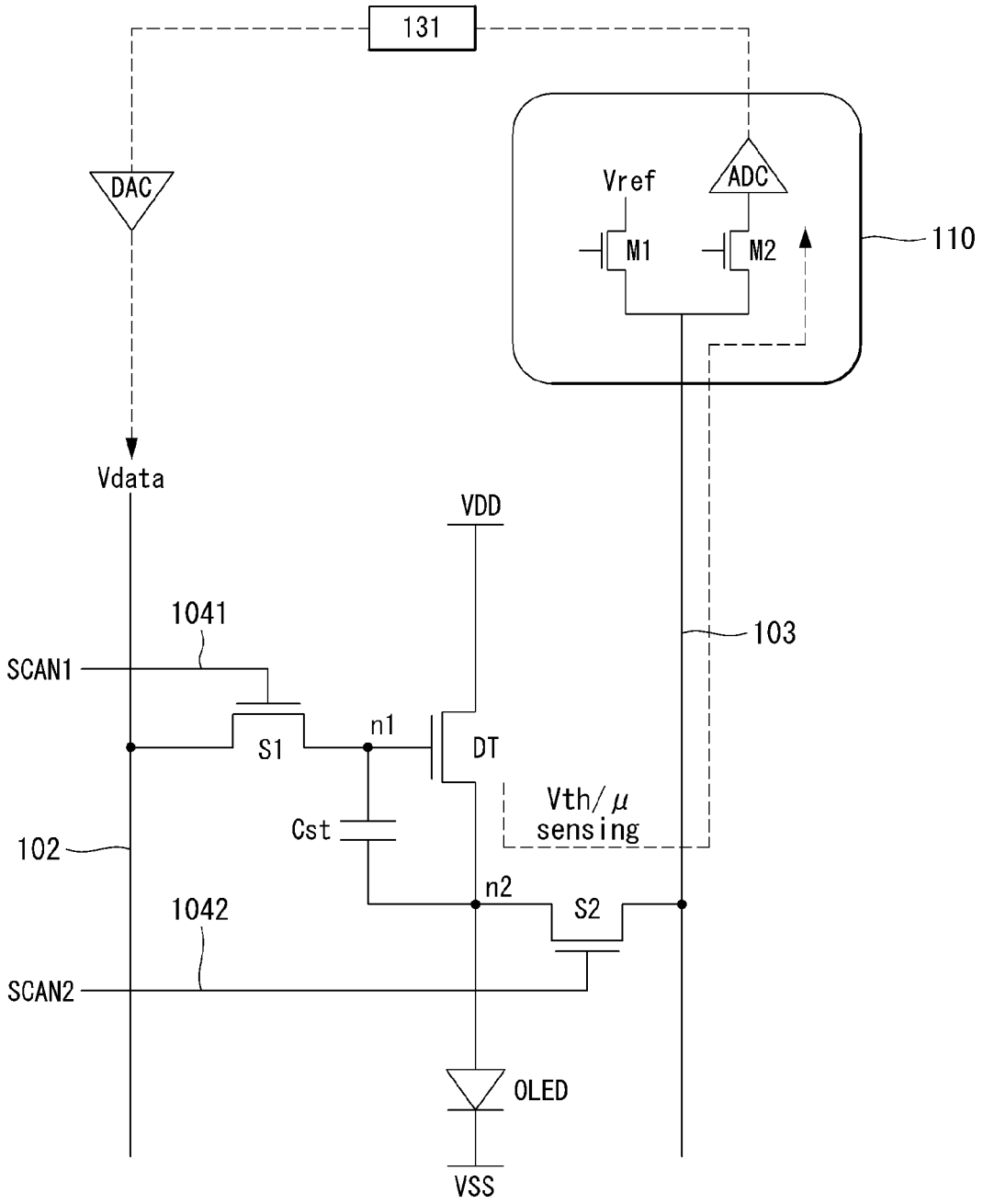
FIG. 2 is a circuit diagram showing a pixel circuit and a sensing path connected to the pixel circuit.

FIG. 1 is a block diagram showing an electroluminescence display according to an exemplary aspect of the present disclosure. FIG. 2 is a circuit diagram showing a sensing path connected to a pixel circuit.

Referring to FIGS. 1 and 2, an electroluminescence display according to an exemplary aspect of the present disclosure comprises a display panel 100 and a display panel drive circuit.

A screen on the display panel 100 comprises an active area AA that displays input images. A pixel array is arranged in the active area AA. The pixel array comprises a plurality of data lines 102, a plurality of gate lines 104 intersecting the data lines 102, and pixels arranged in a matrix.

Each display pixel may be divided into a red subpixel, a green subpixel, and a blue subpixel to produce colors. Each pixel may further comprise a white subpixel. Each subpixel 101 comprises a pixel circuit as illustrated in FIG. 2.

Touch sensors (not shown) may be placed on the display panel 100. Touch input may be sensed using touch sensors or through pixels. The touch sensors may be implemented as on-cell type- or add-on type touch sensors which are placed on the screen of the display panel, or as in-cell type touch sensors embedded in the pixel array.

The display panel drive circuit 110, 112, and 120 comprises a data driver 110 and a gate driver 120. A demultiplexer 112 may be placed between the data driver 110 and the data lines 102.

Figure 5:
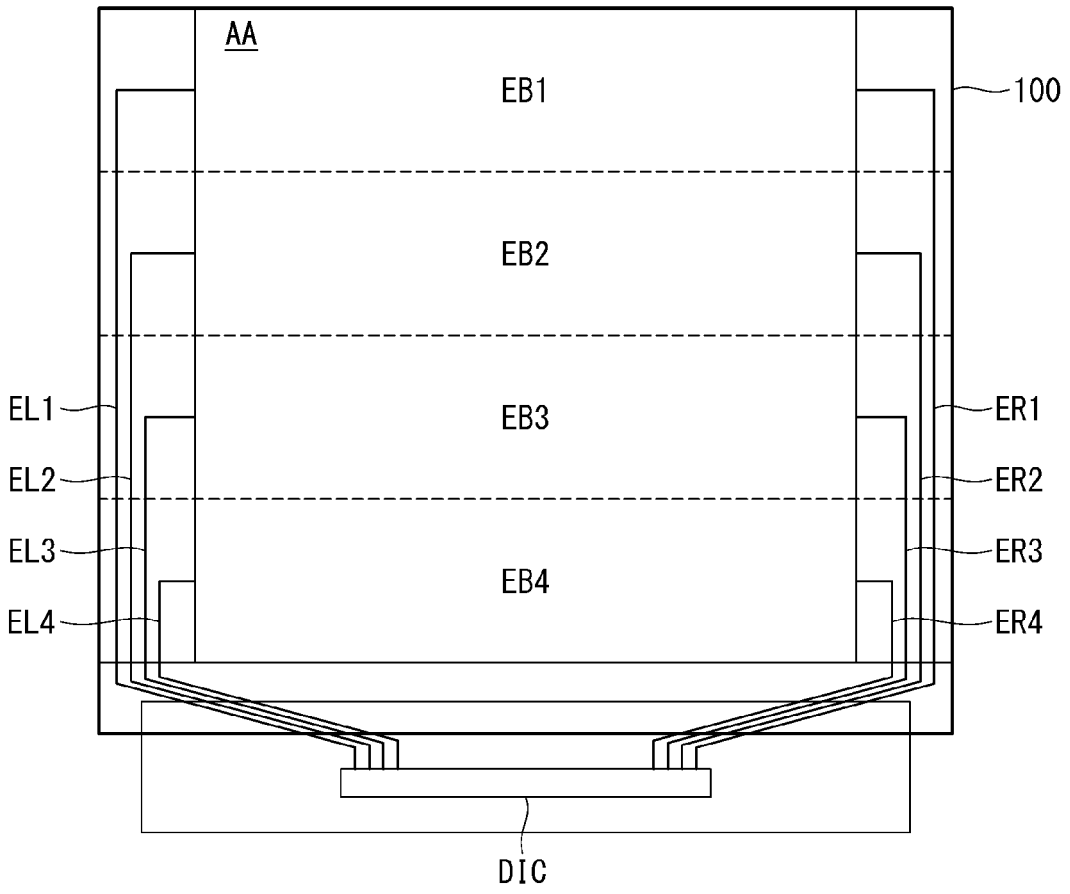
FIGS. 5 and 6 are views showing separate blocks on the screen, to which VDD and VSS are individually supplied.

The display panel drive circuit 110, 112, and 120 writes pixel data of an input image to the pixels of the display panel 100 under control of a timing controller (TCON) 130 to display the input image on the screen during a display driving period. The display panel drive circuit may further comprise a touch sensor driver for driving the touch sensors. The touch sensor driver is omitted in FIG. 1. In a mobile device or wearable device, the data driver 110, the timing controller 130, and power circuit may be integrated in a drive IC (integrated circuit; DIC), as illustrated in FIG. 5.

As illustrated in FIG. 2, the data driver 110 converts pixel data (digital data) of an input image, received from the timing controller 130 for each frame, to gamma-compensated voltages by means of a digital-to-analog converter (hereinafter, DAC) to produce data voltages. The data voltages are supplied to the pixels through the demultiplexer 112 and the data lines 102. The demultiplexer 112 is placed between the data driver 110 and the data lines 102 using a plurality of switching elements and distributes the data voltages output from the data driver 110 to the data lines 102. Because of the demultiplexer 112, one channel of the data driver 110 is time-divided and connected to multiple data lines, thereby reducing the number of data lines 102.

The gate driver 120 may be implemented as a GIP (Gate in Panel) circuit, formed directly in a bezel area on the display panel, along with a transistor array in the active area. The gate driver 120 outputs gate signals to the gate lines 104 under control of the timing controller 130. The gate driver 120 may sequentially supply the gate signals to the gate lines 104 by shifting these signals by a shift register. As illustrated in FIG. 2, the gate signals may be divided into first and second scan signals SCAN1 and SCAN2. The first scan signal SCAN1 is synchronized with a data voltage and selects pixels to which the data voltage is applied. The second scan signal SCAN2 may be synchronized with the first scan signal SCAN1. The second scan signal SCAN2 selects pixels from which the electrical characteristics of the driving elements DT formed in the pixels are sensed using external compensation. The electrical characteristics of the driving elements include mobility μ and threshold voltage Vth.

In external compensation, the threshold voltage Vth or mobility μ of the driving elements may be sensed by activating the second scan signal SCAN2 and connecting the pixel circuits. The sensing method may be divided into before and after product shipment. The threshold voltage of the driving element DT in each subpixel is sensed through a sensing path connected to the pixels before product shipment, and then threshold voltage variations in every subpixel are compensated for based on the sensing results. Moreover, the mobility of the driving element DT in each subpixel may be sensed to thereby compensate for variations in mobility.

Figure 3:
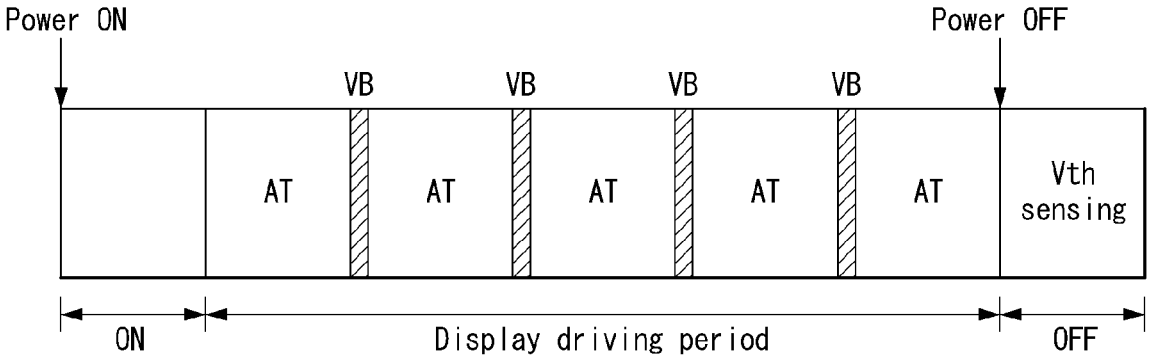
FIG. 3 is a view showing a power ON sequence, a display driving period, and a power OFF sequence.

As illustrated in FIG. 3, the sensing method after product shipment is carried out in a power ON sequence ON, a vertical blanking interval VB, and a power OFF sequence OFF. In the power OFF sequence OFF, after receiving a power-off signal, the display panel drive circuit and the sensing path are further driven for a preset delay time to sense the threshold voltage Vth of the driving element in each subpixel.

The timing controller 130 receives pixel data of an input image and timing signals synchronized with the digital data from a host system (not shown). The timing signals comprise a vertical synchronization signal Vsync, a horizontal synchronization signal Hsync, a clock signal DCLK, and a data enable signal DE. The host system may be any one of the following: a TV (television) system, a set-top box, a navigation system, a personal computer PC, a home theater system, and a mobile device's system.

A vertical synchronization signal Vsync defines 1 frame. A horizontal synchronization signal Hsync defines 1 horizontal time. A data enable signal DE is synchronized with pixel data to be displayed in the pixel array of the display panel 100 and defines the duration of valid pixel data. 1 pulse interval of the data enable signal DE is 1 horizontal time, and the high logic part of the data enable signal DE represents the time during which pixel data for 1 pixel line is inputted. 1 horizontal time 1H is the time required to write data to 1 pixel line of pixels on the display panel 100. Pixel lines are arranged along the gate lines, and each pixel line comprises pixels connected to the same gate line. Pixels of 1 pixel line share a gate line to which a scan signal is applied, and are simultaneously addressed in response to the scan signal from this gate line and supplied with data voltages of pixel data.

The timing controller 130 controls the operation timing of the display panel drive circuit 110, 112, and 120 by generating a data timing control signal for controlling the data driver 110, a switch control signal for controlling the operation timing of the demultiplexer 112, a control signal for the switching elements of the sensing path, and a gate timing control signal for controlling the operation timing of the gate driver 120 based on the timing signals Vsync, Hsync, and DE received from the host system. The voltage level of the gate timing control signal output from the timing controller 130 may be converted to gate-on voltage or gate-off voltage through a level shifter and supplied to the gate driver 120. The level shifter converts the low-level voltage of the gate timing control signal to gate-low voltage VGL and converts the high-level voltage of the gate timing control signal to gate-high voltage VGH.

As illustrated in FIG. 2, the sensing path may comprise a sensing line 103, an analog-to-digital converter (hereinafter, "ADC"), and first and second switching elements M1 and M2. The sensing path may sense the electrical characteristics of a driving element DT by sensing a source voltage at the driving element DT. The first switching element M1 resets the source voltage of the driving element DT to reference voltage Vref by supplying a predetermined reference voltage Vref to the sensing line 103. The second switching element M2 is turned on after the turn-off of the first switching element M1 and supplies the source voltage of the driving element DT to the ADC. The ADC converts analog sensing voltage to digital sensing data and sends it to a compensator 131. The source voltage of the driving element DT may represent the threshold voltage or mobility of the driving element DT depending on the sensing method. The threshold voltage or mobility of the driving element DT may be sensed through the sensing path by using a well-known sensing method. The ADC, along with the DAC, may be integrated in an IC (integrated circuit) of the data driver 110.

The compensator 131 stores compensation values for compensating the threshold voltage Vth and mobility μ of the driving element in each subpixel. The compensator 131 selects a preset compensation value based on digital sensing data received through the ADC, and adds this compensation value to pixel data (digital data) of an input image or multiplies them together to compensate the pixel data. The pixel data thus compensated is sent to the data driver 110 and converted into data voltages Vdata by the DAC of the data driver 110 and supplied to the data lines 102. The driving element DT of a pixel circuit is driven at a data voltage supplied through a data line 102 to generate current. A current flowing to an OLED, i.e., a light-emitting element, through the driving element DT is determined by the gate-source voltage Vgs of the driving element DT. The compensator 131 may be implemented as an operational circuit within the timing controller 130.

FIG. 3 is a view showing a power ON sequence, a display driving period, and a power OFF sequence. FIG. 4 is a view showing in detail an active period AT and a vertical blanking interval VB.

Referring to FIGS. 3 and 4, the power ON sequence ON starts after the display is powered on. In the power ON sequence, a driving voltage for the display panel drive circuit and display panel 100 is generated, and the display panel drive circuit is reset. In the power ON sequence ON and the vertical blanking interval VB of the display driving period, the mobility of the driving element DT is sensed, and variations in the mobility of the driving element DT are compensated for by a mobility compensation value selected based on the sensing result. The mobility compensation value may be updated based on this sensing result of the mobility of the driving element DT. During the display driving period, pixel data written to the pixels for each frame is updated, and an image is displayed on the screen.

The power OFF sequence OFF starts after a display power-off signal is received. In the power OFF sequence OFF, the threshold voltage Vth of each subpixel is sensed during a delay time in which the display panel drive circuit and the sensing path are further driven.

The timing controller 130 receives a data enable signal DE and data of an input image during the active period AT. The data enable signal DE and the input image pixel data are not provided during the vertical blanking interval VB. During the active period AT, 1 frame of data to be written to all the pixels is received by the timing controller 130. 1 frame period is the sum of the active period AT and the vertical blanking interval VB.

As can be seen from the data enable signal DE, no input data is received by the display device during the vertical blanking interval VB. The vertical blanking interval VB comprises a vertical sync time VS, a vertical front porch FP, and a vertical back porch BP. The vertical sync time VS is the time from the falling edge of Vsync to the rising edge, which represents the start (or end) timing of a picture. The vertical front porch FP is the time between the falling edge of the last DE, which is the data timing for the final line of one frame of data, and the start of the vertical sync time VS. The vertical back porch BP is the time between the end of the vertical sync time VS and the rising edge of the first DE, which is the data timing for the first line of one frame of data.

An example of a pixel circuit is shown in FIG. 2. As illustrated in FIG. 2, the pixel circuit comprises an OLED, which is a light-emitting element, a driving element DT connected to the OLED, first and second switching elements S1 and S2, and a capacitor Cst. The driving element and switching elements of the pixel circuit may be implemented as MOSFET (metal oxide semiconductor field effect transistor). The driving element DT and switching elements S1 and S2 are n-type transistors, for example, in FIG. 2, but not limited to them.

The OLED comprises organic compound layers formed between the anode and the cathode. The organic compound layers may comprise, but not limited to, a hole injection layer HIL, a hole transport layer HTL, an emission layer EML, an electron transport layer ETL, and an electron injection layer EIL. The anode of the OLED is connected to the driving element DT via a second node 2, and the cathode of the OLED is connected to a VSS electrode to which a low-level voltage VSS is applied.

The driving element DT drives the OLED by regulating the current in the OLED by the gate-source voltage Vgs. The driving element DT comprises a gate connected to a first node n1, a first electrode (or drain) to which a high-level voltage VDD is supplied, and a second electrode (or source) connected to the anode of the OLED via the second node n2. The capacitor Cst is connected between the gate and source of the driving element DT via the first and second nodes n1 and n2.

The first switching element S1 is turned on in response to a first scan signal SCAN1 and supplies a data voltage Vdata to the gate of the driving element DT connected to the first node n1. The first switching element S1 comprises a gate connected to a first gate line 1041 to which the first scan signal SCAN1 is applied, a first electrode connected to a data line 102, and a second electrode connected to the first node n1.

The second switching element S2 is turned on in response to a second scan signal SCAN2 and supplies a reference voltage Vref to the second node n2. The voltage difference between the reference voltage Vref and the low-level voltage VSS is lower than the threshold voltage of the OLED. Thus, no current flows through the OLED when the reference voltage Vref is applied to the anode of the OLED, whereby the OLED emits no light. The second switching element S2 comprises a gate connected to a second gate line 1042 to which the second scan signal SCAN2 is applied, a first electrode connected to the sensing line 103 to which the reference voltage Vref is applied, and a second electrode connected to the second node n2.

The high-level voltage VDD is applied to the anode of the OLED through the driving element DT. The low-level voltage VSS is applied to the cathode of the OLED. Thus, the high-level voltage VDD is supplied to the anode of the OLED through the driving element DT.

Figure 6:
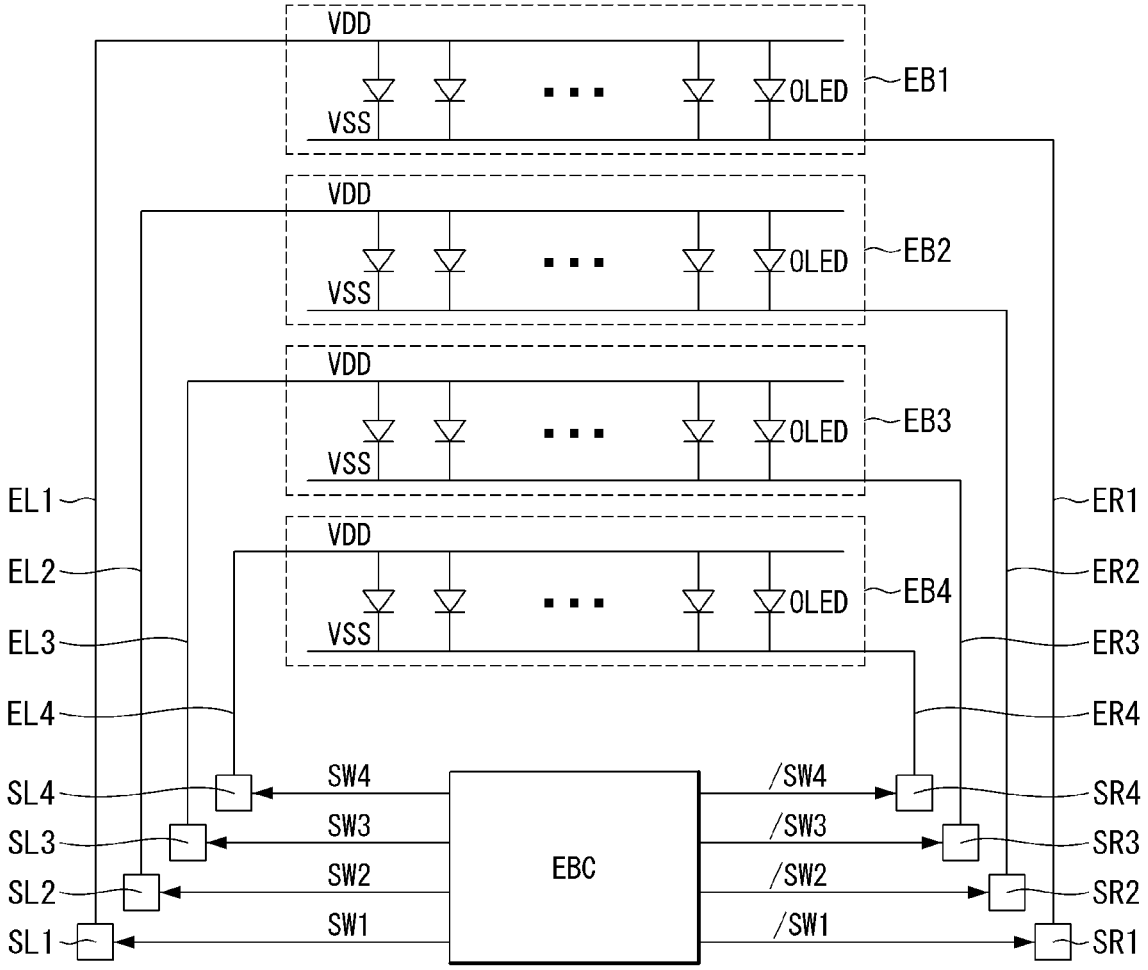

FIGS. 5 and 6 are views showing separate blocks on the screen, to which VDD and VSS are individually supplied. The driving element, switching elements, and capacitor of the pixel circuit are omitted in FIG. 6.

Referring to FIGS. 5 and 6, a screen AA on the display panel 100 may be driven in at least two separate blocks. The first and second blocks EB1 and EB2 each comprise a plurality of pixels. The display panel comprises first and second power lines (or feed lines) connected to the pixels in the first block EB1, a first switching circuit for switching the voltage supplied to the first power line between VDD and VSS, a second switching circuit for switching the voltage supplied to the second power line between VDD and VSS, third and fourth power lines connected to the pixels in the second block EB2, a third switching circuit for switching the voltage supplied to the third power line between VDD and VSS, and a fourth switching circuit for switching the voltage supplied to the fourth power line between VDD and VSS.

The screen AA on the display panel 100 is divided into a plurality of blocks EB1 to EB4. Power lines EL1 to EL4 and ER1 to ER4 are separated among the blocks EB1 to EB4 to supply VDD and VSS individually to the blocks EB1 to EB4. The power lines EL1 to EL4 and ER1 to ER4 are divided into VDD power lines EL1 to EL4 and VSS power lines ER1 to ER4. The VDD power lines EL1 to EL4 are separated into different blocks and connected to the anodes of the pixels. The VDD power lines EL1 to EL4 may be connected to the anodes of the pixels through the driving elements DT. The VSS power lines ER1 to ER4 are separated between different blocks and connected to the cathodes of the pixels. The anodes of the pixels are connected to the anodes of the OLEDs, and the cathodes of the pixels are connected to the cathodes of the OLEDs.

The pixels in the first block EB1 are connected to the first VDD power line EL1 and the first VSS power line ER1. The pixels in the second block EB2 are connected to the second VDD power line EL2 and the second VSS power line ER2. The pixels in the third block EB3 are connected to the third VDD power line EL3 and the third VSS power line ER3. The pixels in the fourth block EB4 are connected to the fourth VDD power line EL4 and the fourth VSS power line ER4.

The power lines EL1 to EL4 and ER1 to ER4 may be distributed in left and right bezel areas around the screen AA on the display panel 100. For example, the first to fourth VDD power lines EL1 to EL4 may be placed in the left bezel area of the display panel 100. The first to fourth VSS power lines ER1 to ER4 may be placed in the right bezel area of the display panel 100.

Switching circuits SL1 to SL4 and SR1 to SR4 are connected to the power lines EL1 to EL4 and ER1 to ER4, respectively. The switching circuits SL1 to SL4 and SR1 to SR4 select between VDD and VSS under control of a block controller EBC and supply them to the power lines EL1 to EL4 and ER1 to ER4. The block controller EBC generates switching control signals SW1 to SW4 and /SW1 to /SW4 to control the operation timings of the switching circuits SL1 to SL4 and SR1 to SR4.

Figure 11A:
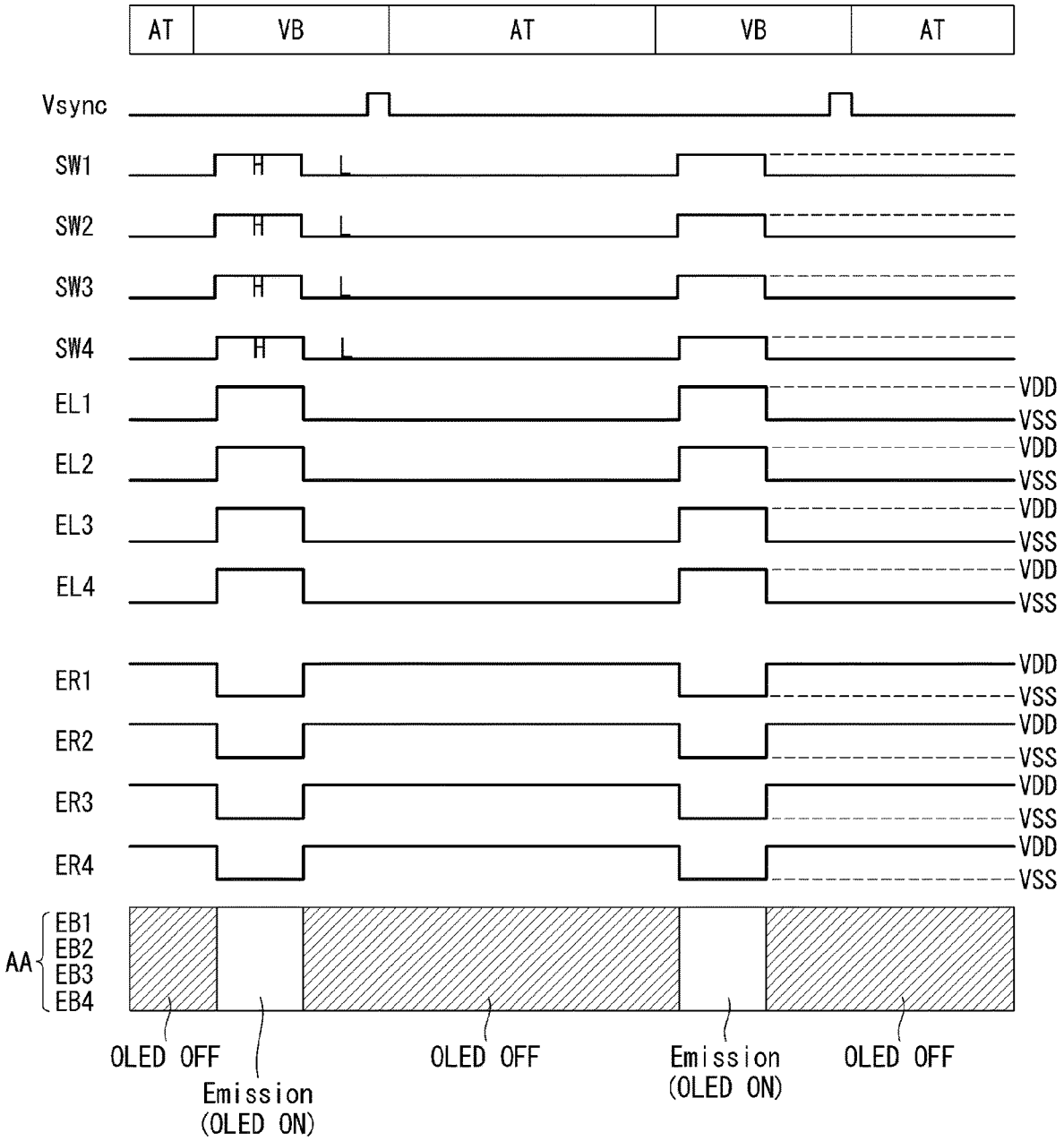
FIGS. 11A and 11B are waveform diagrams showing a method of driving blocks in response to switching control signals.
Figure 11B:
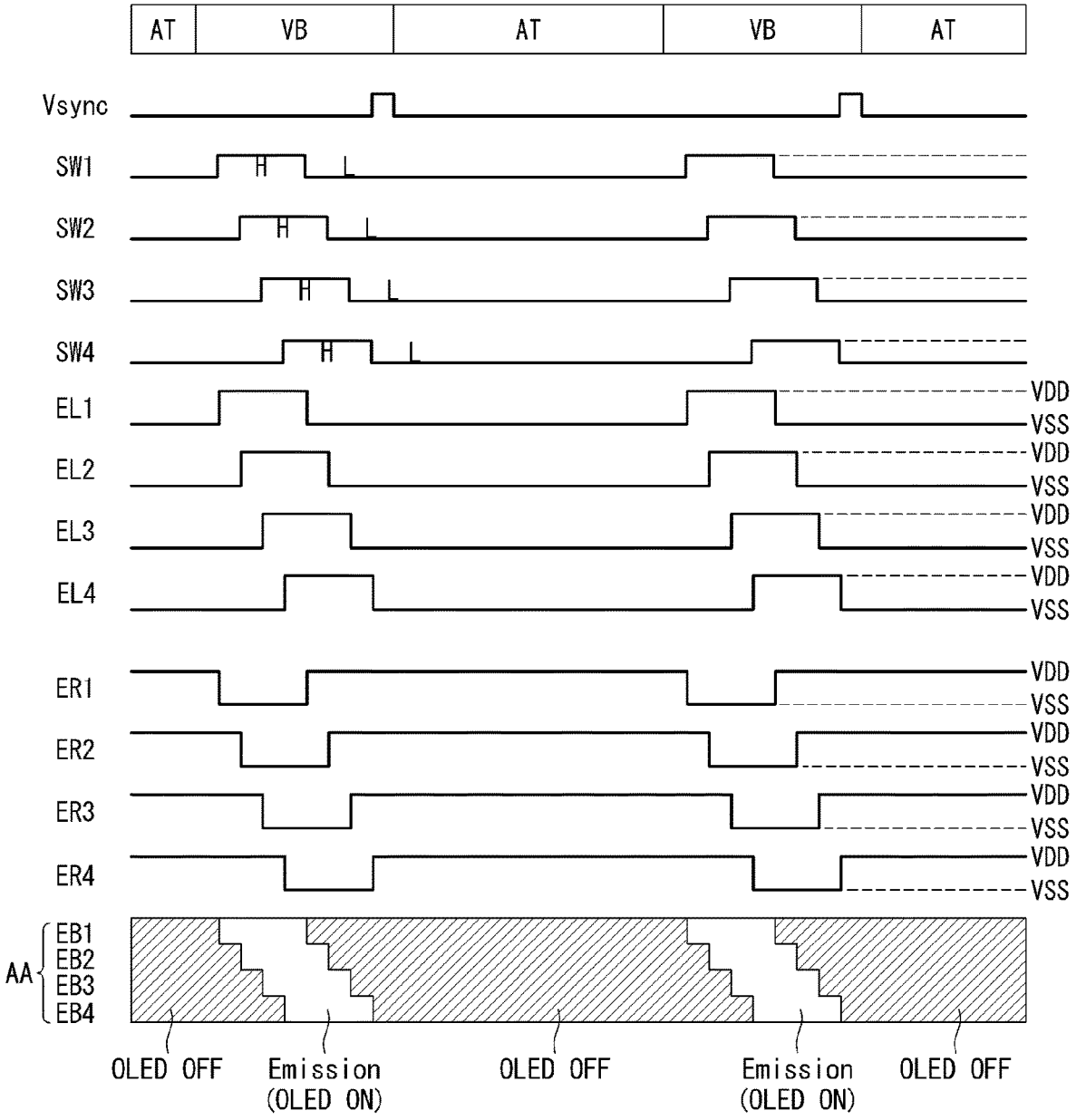

The 1-1th switching circuit SL1 selects between VDD and VSS in response to the first switching control signal SW1 and supplies them to the first VDD power line ELL The 1-2th switching circuit SR1 selects between VDD and VSS in response to the first inverted switching control signal /SW1 and supplies them to the first VSS power line ER1. The first switching control signal SW1 and the first inverted switching control signal /SW1 have opposite phases. Thus, as shown in FIG. 11A and FIG. 11B, the 1-1th switching circuit SL1 supplies VDD to the first VDD power line EL1 when the first switching control signal SW1 is at high logic level H. At the same time, the 1-2th switching circuit SR1 supplies VSS to the first VSS power line ER1 in response to the low logic level L of the first inverted switching control signal /SW1.

The 2-1th switching circuit SL2 selects between VDD and VSS in response to the second switching control signal SW2 and supplies them to the second VDD power line EL2. The 2-2th switching circuit SR2 selects between VDD and VSS in response to the second inverted switching control signal /SW2 and supplies them to the second VSS power line ER2. The second switching control signal SW2 and the second inverted switching control signal /SW2 have opposite phases. Thus, as shown in FIG. 11A and FIG. 11B, the 2-1th switching circuit SL2 supplies VDD to the second VDD power line EL2 when the second switching control signal SW2 is at high logic level H. At the same time, the 2-2th switching circuit SR2 supplies VSS to the second VSS power line ER2 in response to the low logic level L of the second inverted switching control signal /SW2.

The 3-1th switching circuit SL3 selects between VDD and VSS in response to the third switching control signal SW3 and supplies them to the third VDD power lineEL3. The 3-2th switching circuit SR3 selects between VDD and VSS in response to the third inverted switching control signal /SW3 and supplies them to the third VSS power line ER3. The 4-1th switching circuit SL4 selects between VDD and VSS in response to the fourth switching control signal SW4 and supplies them to the fourth VDD power line EL4. The 4-2th switching circuit SR4 selects between VDD and VSS in response to the fourth inverted switching control signal /SW4 and supplies them to the fourth VSS power line ER4.

Figure 7:
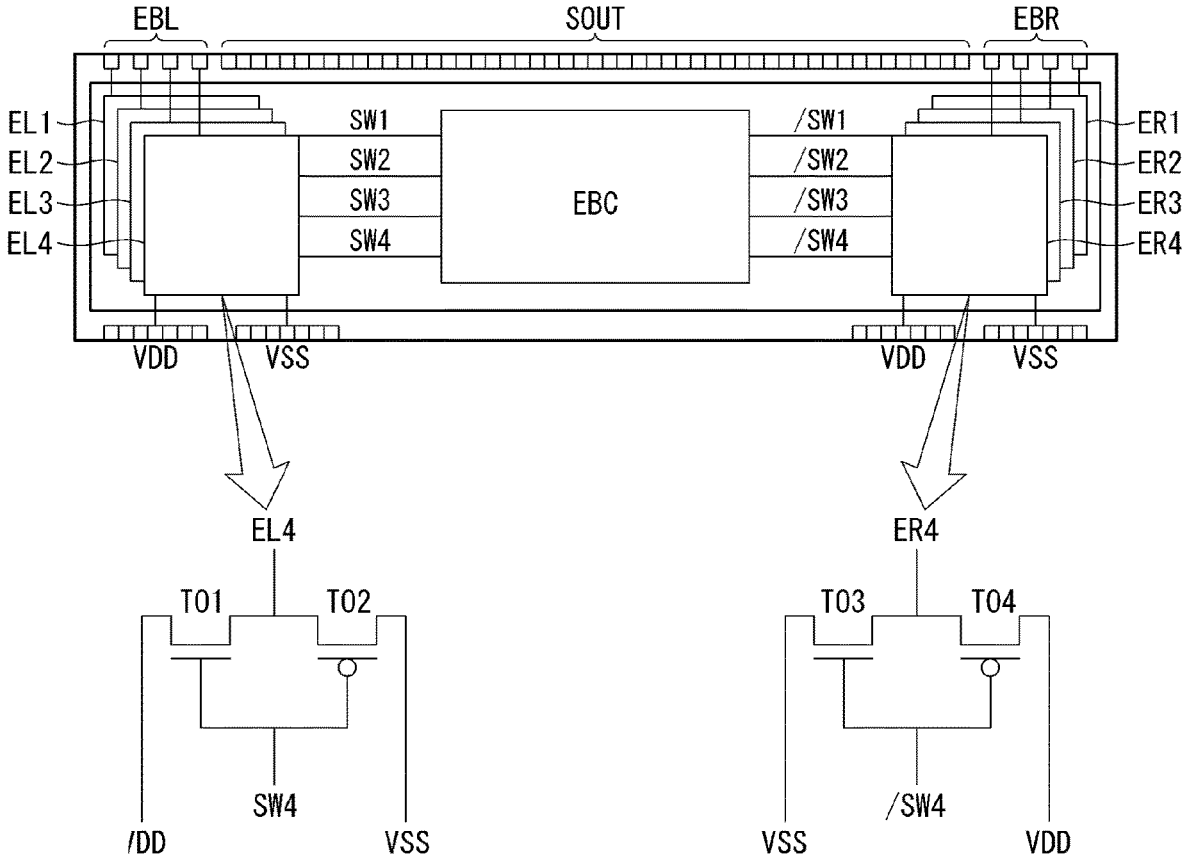
FIG. 7 is a circuit diagram showing a switching circuit for switching between VDD and VSS and a block controller.

The block controller EBC and the switching circuits SL1 to SL4 and SR1 to SR4 may be implemented in an IC, or may be integrated in a drive IC (DIC), along with the data driver 110, as shown in FIG. 7.

Referring to FIG. 7, the switching circuits SL1 to SL4 each comprise switching elements T01 and T02 for selecting between VDD and VSS in response to the switching control signals SW1 to SW4. The switching element T01 may be implemented as an n-channel transistor, and the switching element T02 may be implemented as a p-channel transistor. The switching element T01 is turned on in response to the high logic level voltage of the switching control signals SW1 to SW4 and supplies VDD to the VDD power lines EL1 to EL4. The switching element T02 is turned on in response to the low logic level voltage of the switching control signals SW1 to SW4 and supplies VSS to the VDD power lines EL1 to EL4. In the drive IC (DIC), first power output pads EBL connect the output terminals of the switching circuits SL1 to SL4 to the VDD power lines EL1 to EL4.

The switching circuits SR1 to SR4 each comprise switching elements T03 and T04 for selecting between VDD and VSS in response to the inverted switching control signals /SW1 to /SW4. The switching element T03 may be implemented as an n-channel transistor, and the switching element T04 may be implemented as a p-channel transistor. The switching element T03 is turned on in response to the high logic level voltage of the inverted switching control signals /SW1 to /SW4 and supplies VDD to the VSS power lines ER1 to ER4. The switching element T04 is turned on in response to the low logic level voltage of the inverted switching control signals /SW1 to /SW4 and supplies VSS to the VSS power lines ER1 to ER4. In the drive IC (DIC), second power output pads EBR connect the output terminals of the switching circuits SR1 to SR4 to the VSS power lines ER1 to ER4.

A COF (chip on film) with the driver IC (DIC) mounted on it is bonded onto the display panel 100. Source output pads of the drive IC (DIC) are electrically connected to the data lines on the display panel 100.

Figure 8:
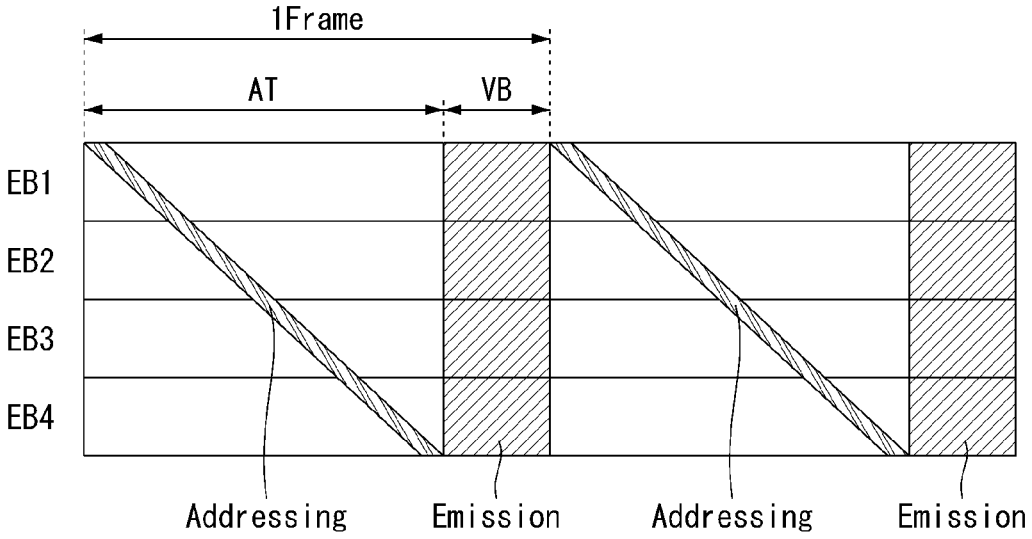
FIGS. 8 to 10 are views showing various block driving methods applicable in the present disclosure.
Figure 9:
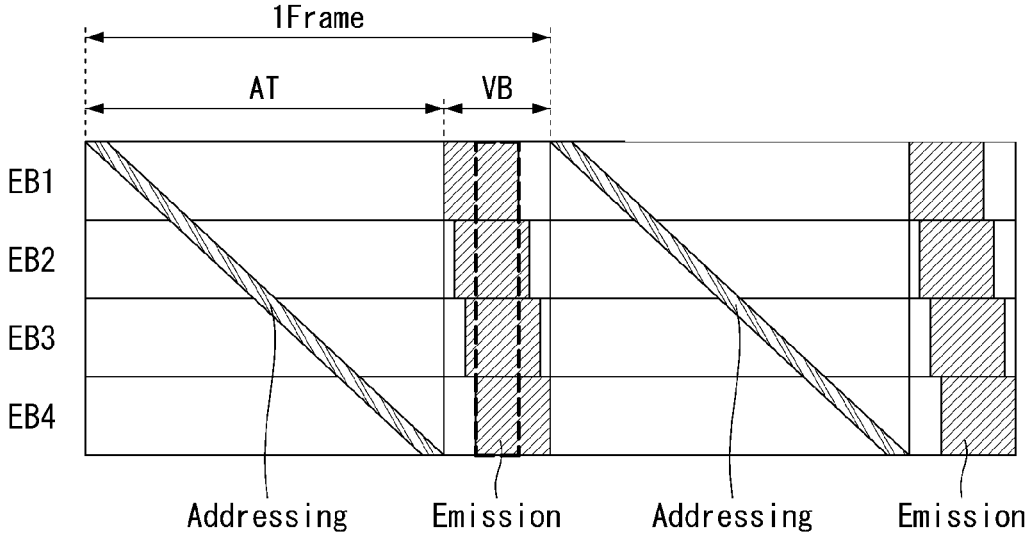
Figure 10:
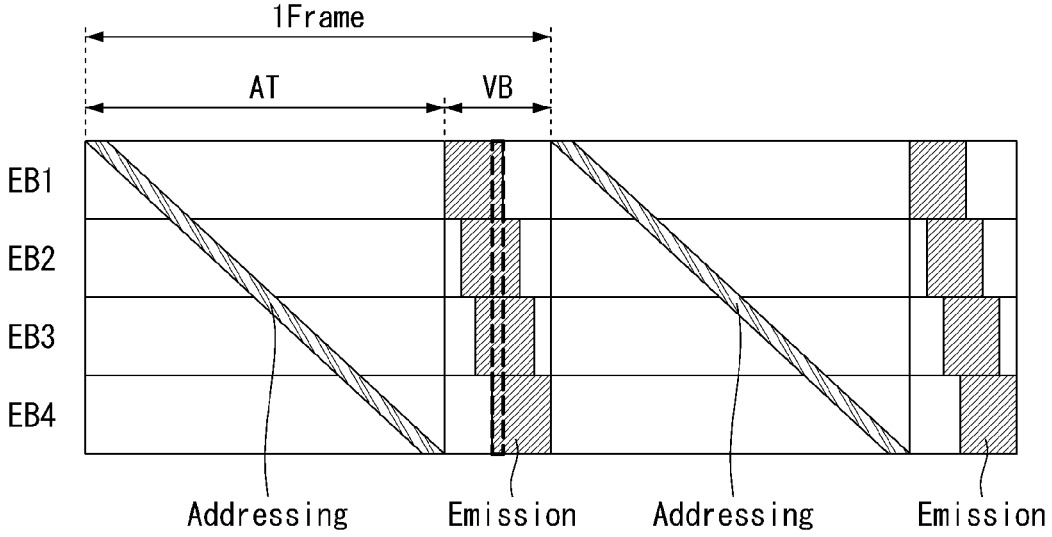

The block controller EBC may control the light emission timings of the pixels in various block driving methods, as illustrated in FIGS. 8 to 10, by turning on/off the switching control signals SW1 to SW4 and /SW1 to /SW4 according to a preset block driving method.

FIGS. 8 to 10 are views showing various block driving methods applicable in the present disclosure.

Referring to FIGS. 8 to 10, the gate driver 120 sequentially supplies scan signals SCAN1 synchronized with data voltages to the gate lines 104, from the first pixel line to the Nth pixel line, during the active period AT of each frame. The Nth pixel line is the last pixel line which is addressed by the last scan signal within the active period AT. The pixels are addressed on a per-pixel line basis during the active period AT. Pixel data is written to the pixels addressed by the scan signals.

As illustrated in FIG. 8, the block controller EBC may allow the pixels in all of the blocks EB1 to EB4 to emit light simultaneously during the vertical blanking interval VB, in which there is no pixel data input. This method is known as a "global shutter" method because the pixels across the entire screen are simultaneously turned on or off. The global shutter method may improve motion blur since pixels are driven through impulses on virtual reality devices (VR) which require a high frame frequency.

The block controller EBC may drive the pixels as illustrated in FIGS. 9 and 10. As illustrated in FIGS. 9 and 10, pixels with pixel data written to them may be supplied with VDD and VSS between which the voltage is switched under control of the block controller EBC and emit light, with their light emission period shifted in the order of first to fourth blocks EB1 to EB4. The other blocks including the pixels addressed before the addressing of the Nth pixel line may be driven in the light emission period. For example, the pixels in the first to third blocks EB1 to EB3 may be driven in the light-emission period before the addressing of the last pixel line, and the light-emission period may be shifted on a block-by-block basis. Here, the light-emission periods of the blocks EB1 to EB4 are sequentially shifted at predetermined time intervals. By the way, as indicated in the thick dotted lines in FIGS. 9 and 10, there is an impulse driving period, in which the light-emission periods of all the blocks EB1 to EB4 overlap on the time axis within the vertical blanking interval VB and the pixels in these blocks EB1 to EB4 simultaneously emit light. Since the pixels in all the blocks EB1 to EB4 simultaneously emit light during the impulse driving period, the present disclosure may improve motion blur. Moreover, peak current is distributed because the power lines are separated between the blocks, thereby improving EMI.

The block controller EBC may adjust the light emission timings of the pixels by selecting one of the block driving methods of FIGS. 8 to 10 according to register settings. The block controller EBC may control the light emission timings of the blocks EB1 to EB4 by the block driving method of FIG. 8 by inverting the switching control signals SW1 to SW4 to high logic level H simultaneously during the vertical blanking interval VB. When the switching control signals SW1 to SW4 are inverted to high logic level H, the inverted switching control signals /SW1 to /SW4 are inverted to low logic level L. When the switching control signals SW1 to SW4 are at high logic level H, VDD is applied to the VDD power lines EL1 to EL4 and VSS is applied to the VSS power lines ER1 to ER4. In this instance, VDD is applied to the driving TFTs (DT) of the pixel circuits, and VSS is applied to the cathodes of the OLEDs, thereby allowing the OLEDs to emit light.

As shown in FIG. 11A, the block controller EBC may control the light-emission timings of the blocks EB1 to EB4 simultaneously by controlling the on/off timings of the switching control signals SW1 to SW4 and /SW1 to /SW4 during the vertical blanking interval VB. The light-emission periods of the blocks EB1 to EB4 may be set within the vertical blanking interval VB during which there is no pixel data of an input image. The light-emission period of each of the blocks EB1 to EB4 may be shorter than the vertical blanking interval VB, and the impulse driving period may be shorter than the light-emission period. In FIG. 11A, the light-emission periods of the blocks EB1 to EB4 start and end simultaneously.

The block controller EBC may sequentially shift the on/off timings of the switching control signals SW1 to SW4 and /SW1 to /SW4 on a block-by-block basis during the vertical blanking interval VB as shown in FIG. 11B so that the light-emission timings of the blocks EB1 to EB4 are sequentially shifted on a block-by-block basis as in the block driving methods of FIGS. 9 and 10. For example, the light-emission period (second light-emission period) of the second block EB2 may start after the start of the light-emission period (first light-emission period) of the first block EB1. The second light-emission period may end after the end of the first light-emission period.

During the active period AT in which the pixels are addressed, the switching control signals SW1 to SW4 are maintained at logic low level L. Thus, VSS is applied to the VDD power lines EL1 to EL4, and VDD is applied to the VSS power lines ER1 to ER4. In this instance, VSS is applied to the driving TFTs (DT) of the pixel circuits, and a reverse bias voltage is applied to the OLEDs since the cathode voltage of the OLEDs is VDD, whereby the OLEDs emit no light.

The pixel circuits in each block are substantially identical. Each subpixel in the first block EB1 comprises an OLED whose cathode is connected to the first VSS feed line ER1, a driving element DT connected to the first VDD power line EL1, for driving the OLED, a first switching element S1 which is turned on in response to a first scan signal synchronized with a data voltage to supply the data voltage to the gate of the driving element DT, a second switching element S2 which is turned on in response to a second scan signal to supply a reference voltage Vref to the source of the driving element DT and the anode of the OLED, and a capacitor Cst connected between the gate and source of the driving element DT.

Each subpixel in the second block EB2 comprises an OLED whose cathode is connected to the second VSS power line ER2, a driving element DT connected to the second VDD power line EL2, for driving the OLED, a first switching element S1 which is turned on in response to a first scan signal synchronized with a data voltage to supply the data voltage to the gate of the driving element DT, a second switching element S2 which is turned on in response to a second scan signal to supply a reference voltage Vref to the source of the driving element DT and the anode of the OLED, and a capacitor Cst connected between the gate and source of the driving element DT.

Figure 12:
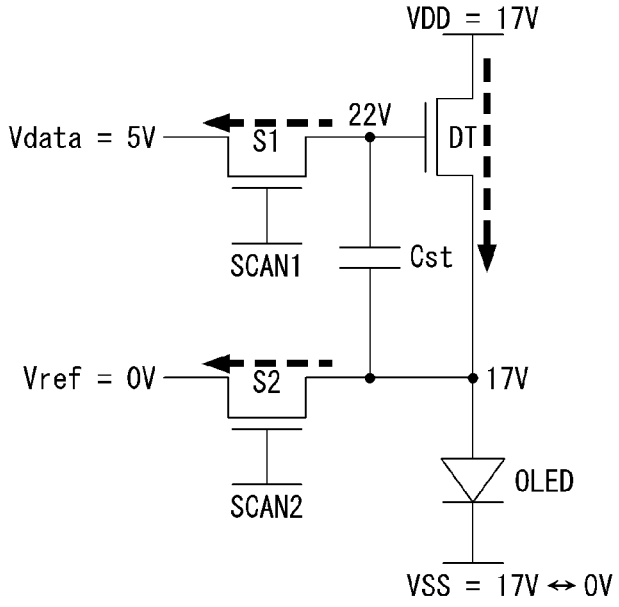
FIG. 12 is a circuit diagram showing an example of a flow of leakage current in a pixel circuit when VDD is fixed and VSS swings.
Figure 13:
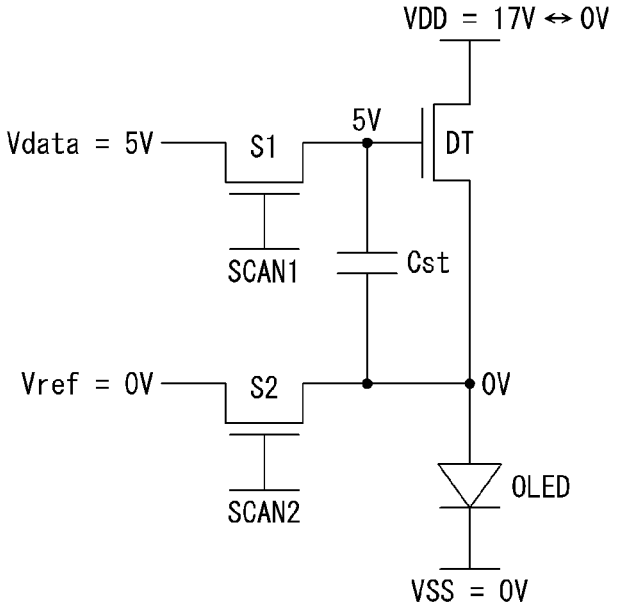
FIG. 13 is a circuit diagram showing an example of a flow of leakage current in a pixel circuit when VSS is fixed and VDD swings.

The cathode voltage VSS of the OLEDs in the pixels may swing to alternating current voltage in order to adjust the light emission timings of the pixels. In this method, however, a leakage current may be generated in the pixels if VDD is fixed. In the present disclosure, the anode voltage VDD and cathode voltage of the OLEDs may be changed simultaneously according to the emission or non-emission periods of the pixels, thereby minimizing the leakage current in the pixels and reducing luminance degradation caused by the leakage current. This will be described in conjunction with FIGS. 12 and 13. In FIGS. 12 and 13, the data voltage Vdata is 5 V, and the reference voltage Vref is 0 V.

Referring to FIG. 12, when the voltage of the VSS power line to which the cathode of the OLED is connected swings between 17 V and 0 V and the voltage of the VDD power line is fixed at 17 V, 17 V is applied to the anode of the OLED when the driving element DT is turned on. While the OLED is turned on and emits light when the cathode voltage of the OLED is 0V, the OLED emits no light when the cathode voltage of the OLED is 17 V. When the anode voltage of the OLED rises to 17 V, the voltage of the first node n1 rises to 22 V due to coupling through the capacitor Cst. As a result, the drain-source voltage Vds of the switching elements S1 and S2 becomes higher, and a leakage current flows through the switching elements S1 and S2, as indicated by the arrows. This leakage current leads to a decrease in the gate-source voltage Vgs of the driving element DT, thus reducing the current in the OLED and lowering the brightness of the pixel.

Referring to FIG. 13, while the voltage of the VSS power line to which the cathode of the OLED is connected is fixed at VSS=GND=0V, the voltage of the VDD power line swings between 17 V and 0 V. While the OLED is turned on and emits light when the anode voltage of the OLED is 17 V, the OLED emits no light when the anode voltage of the OLED is 0 V. By controlling the light emission timing of the OLED by varying the anode voltage of the OLED through VDD swings, the leakage current flowing through the switching elements S1 and S2 may be reduced since VDD is low—that is, VDD=0 V, during the non-emission period of the OLED. The leakage current in the switching elements S1 and S2 may be minimized by properly regulating the reference voltage Vref. For example, if the reference voltage Vref is increased to a voltage (e.g., 3 V) higher than 0 V, this reduces the Vds of the switching elements S1 and S2, thereby minimizing leakage current.

The operation of the pixel circuit may be divided into a reset and data write step and a light emission step. In the pixel circuit operation, leakage current differs depending on a VSS swings or VDD swing. This will be described in conjunction with FIGS. 14 to 19.

Figure 14:
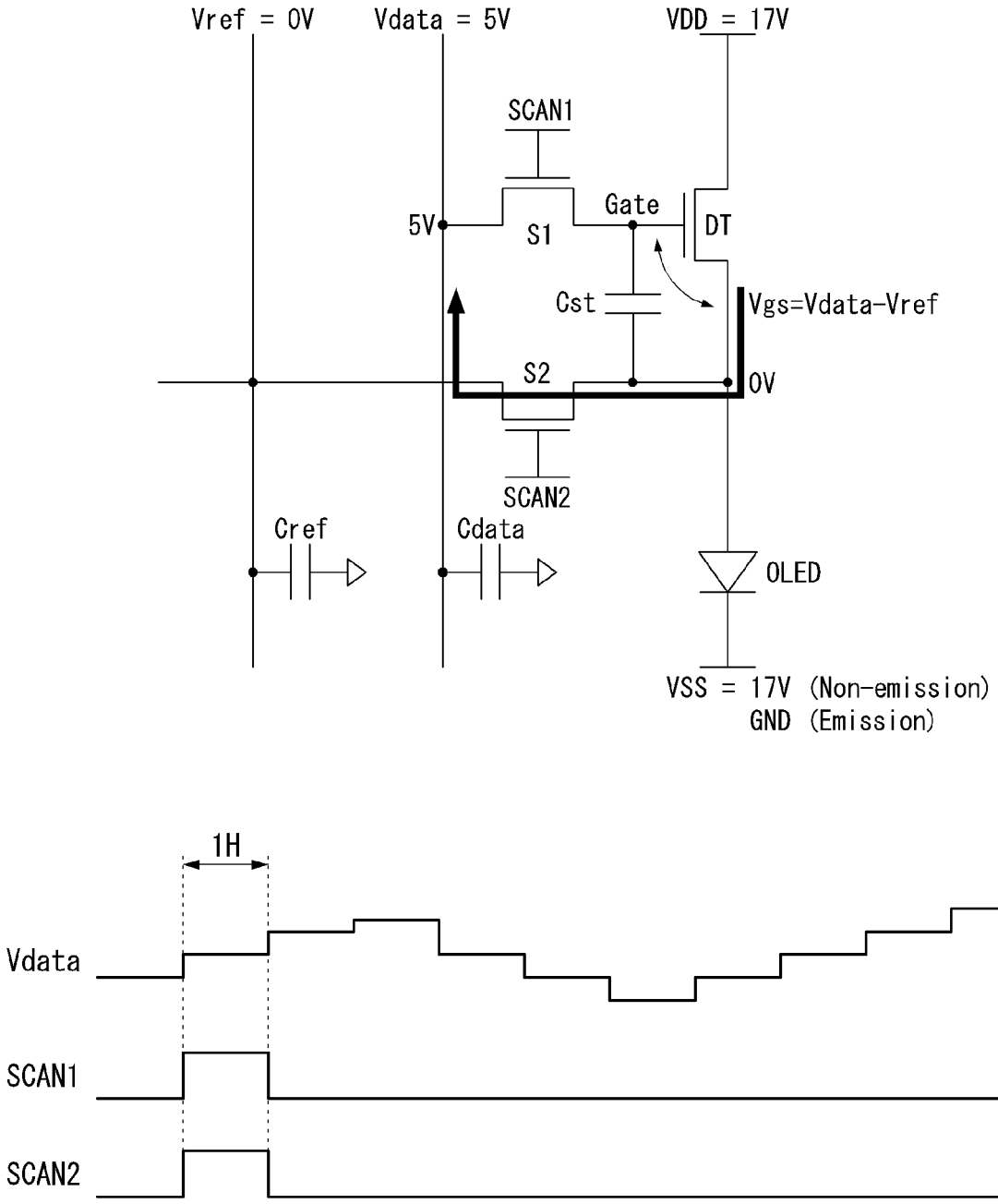
FIGS. 14 to 16 are views showing in detail how a pixel circuit operates when VSS swings.
Figure 15:
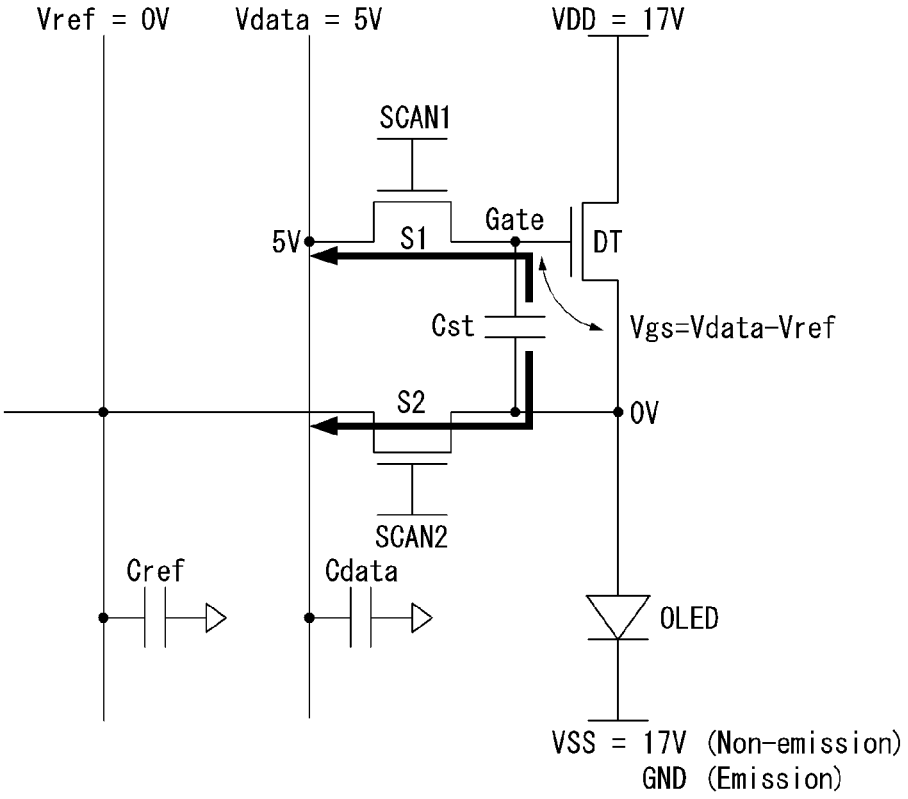
Figure 15:
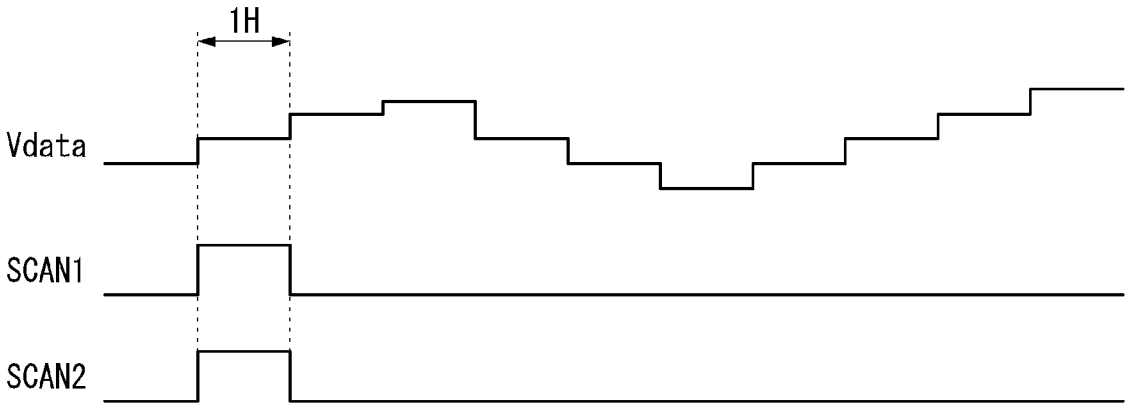
Figure 16:
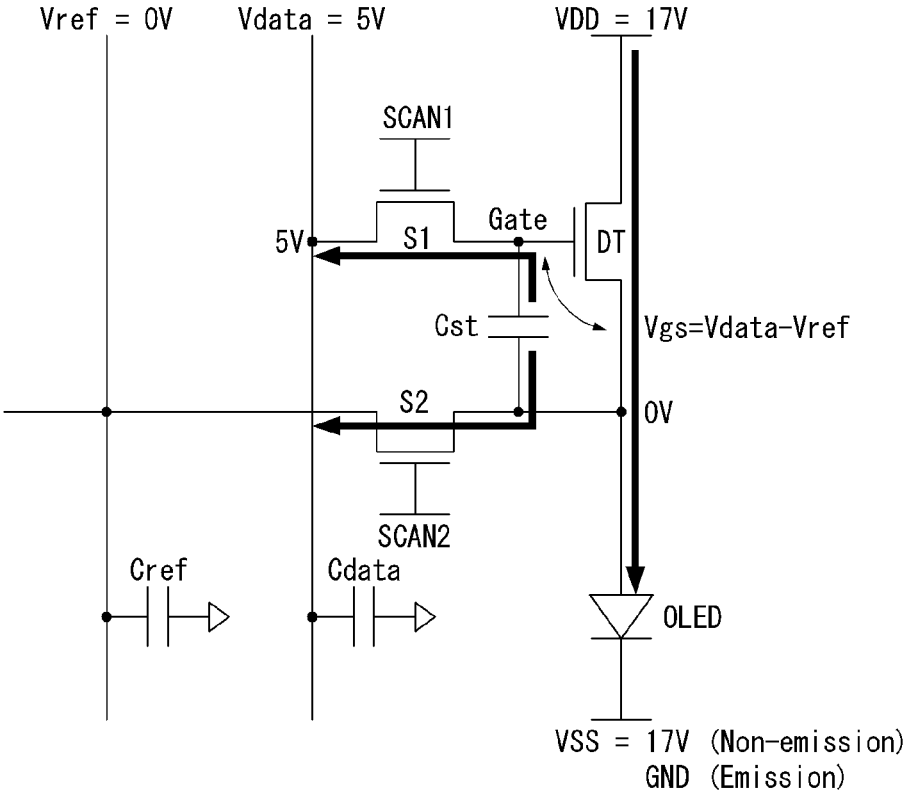

FIGS. 14 to 16 show how a pixel circuit operates when VSS swings.

FIGS. 14 to 16 show how a pixel circuit operates in the reset and data write step of the capacitor Cst.

Referring to FIG. 14, in the reset and data write steps of the capacitor, the driving voltage of the pixel circuit is VDD=17 V, VSS=17 V, and Vref=0 V. In this instance, the voltages of the first scan signal SCAN1 and the second scan signal SCAN2 rise to VGH, thereby turning on the switching elements S1 and S2.

In the reset and data write step of the capacitor, a data voltage (Vdata=5 V) is applied to the gate of the driving element DT, and a reference voltage (Vref=0 V) is applied to the source of the driving element DT. Thus, in the reset and data write step, the gate-source voltage Vgs of the driving element DT is Vgs=Vdata−Vref, which is equal to the voltage of the capacitor Cst. The gate voltage Vg, source voltage Vs, and drain-source voltage Vds of the driving element DT are 5V, 0 V, and 17 V, respectively.

In the reset and data write step of the capacitor, the Vgs of the driving element DT is higher than the threshold voltage Vth, whereby the driving element DT is turned on and the current Ids between the drain and source of the driving element DT flows as indicated by the arrow. In this instance, VSS=17 V is applied to the cathode of the OLED, and the OLED remains off and no current flows through the OLED.

The source voltage of the driving element DT rises up to 17 V due to the current Ids in the driving element DT, and the gate voltage of the driving element DT rises up to 5 V+17 V=22 V due to coupling through the capacitor Cst. In this instance, the Vgs of the driving element DT is maintained at 5 V, and therefore the voltage stored in the capacitor Cst remains and no data voltage is lost.

FIG. 15 shows the current in the pixel circuit prior to the light emission step.

Referring to FIG. 15, the driving voltage of the pixel circuit is maintained at VDD=17 V, VSS=17 V, and Vref=0 V. As the voltages of the scan signals SCAN1 and SCAN2 are changed to VGL, the switching elements S1 and S2 are turned off. There should be no leakage current in the switching elements S1 and S2 while the scan signals SCAN1 and SCAN2 are off, but a leakage current flows through the switching elements S1 and S2 if VDD is maintained at a high voltage of 17 V, as illustrated in FIG. 15.

The Vgs of the driving element DT is lower than Vth immediately after the voltages of the scan signals SCAN1 and SCAN2 are changed to VGL. Thus, the driving element DT is turned off, and no current Ids flows through the driving element DT. By the way, the Vds of S1 is Vds=22 V−5 V, and the Vds of the second switching element S2 is Vds=17 V−0, which means that the Vds of the first switching element S1 and the second switching elements S2 is high, whereby a leakage current flows in the direction of the arrows. If the display panel 100 has a high resolution and a high PPI (pixel per inch), the capacitance of the storage capacitor Cst is small. This leads to a large variation in the Vgs of the driving element DT, making the brightness of the pixels susceptible.

FIG. 16 shows the current in the pixel circuit in the light emission step.

Referring to FIG. 16, VSS is changed to 0 V in the light emission step, and the driving voltage of the pixel circuit is VDD=17 V, VSS=0 V, and Vref=0 V. In the light emission step, the switching elements S1 and S2 are in the off state.

In the light emission step, the voltage of the driving element DT is Vg=22 V, Vs=0V, Vgs=5V, and Vds=17V, and the driving element DT is turned on. Thus, through the driving element DT, the source voltage of the driving element DT, i.e., the anode voltage of the OLED, rises, and the OLED is turned on. In this instance, when the driving voltage of the OLED reaches Voled, the voltage of the driving element DT is maintained at Vg=22 V−Vx, Vs(Voled)=17 V−Vx, and Vgs=5V due to coupling through the capacitor Cst, and the two ends of the OLED emit light at Voled.

Although the switching elements S1 and S2 are in the off state in the light emission step, the Vds of the first switching element S1 is equal to 22 V−Vx−5V and the Vds of the second switching element S2 is equal to 17 V−Vx−0V, which are high. Thus, a leakage current is generated through the switching elements S1 and S2.

Figure 17:
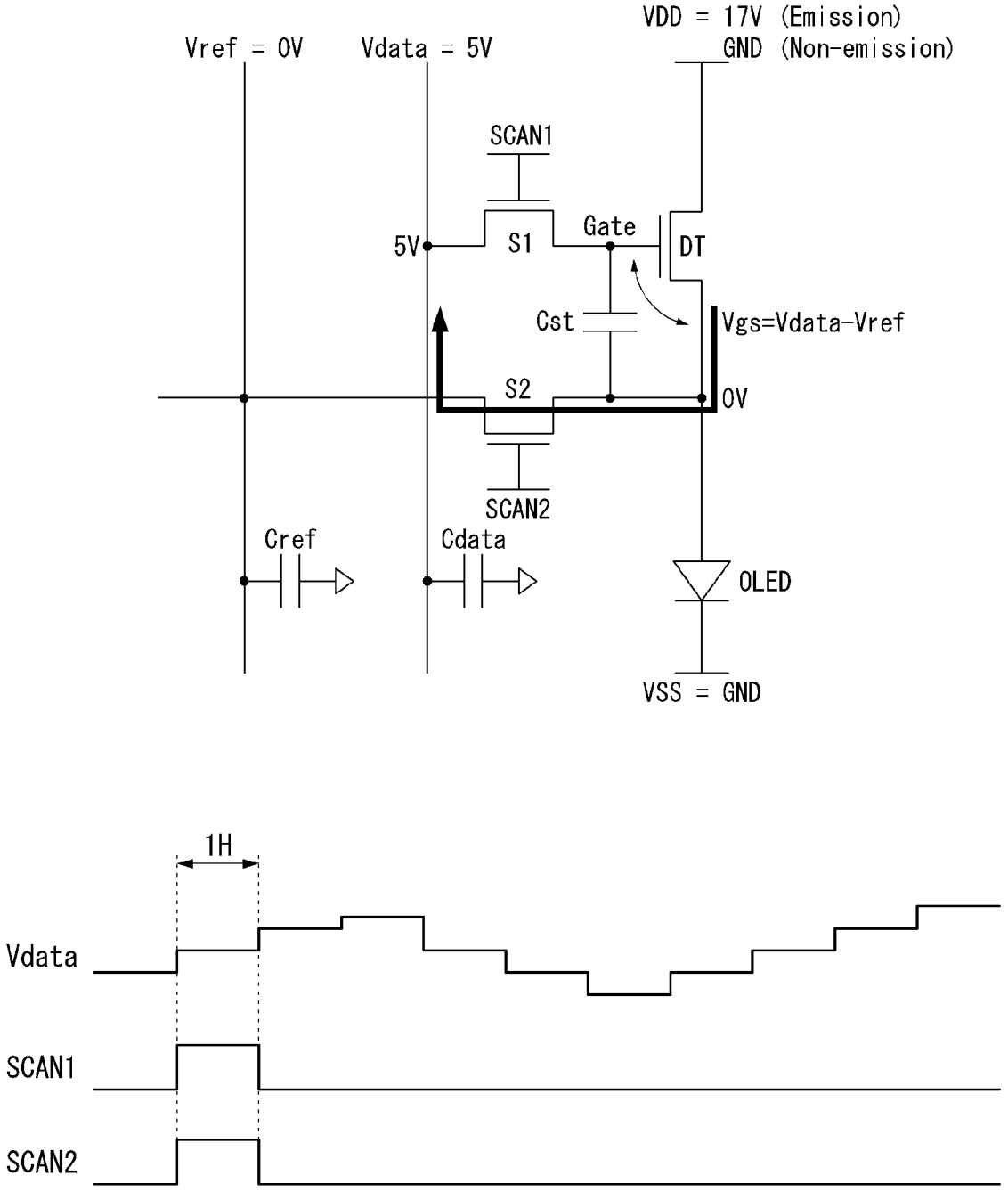
FIGS. 17 to 19 are views showing in detail how a pixel circuit operates when VDD swings.
Figure 18:
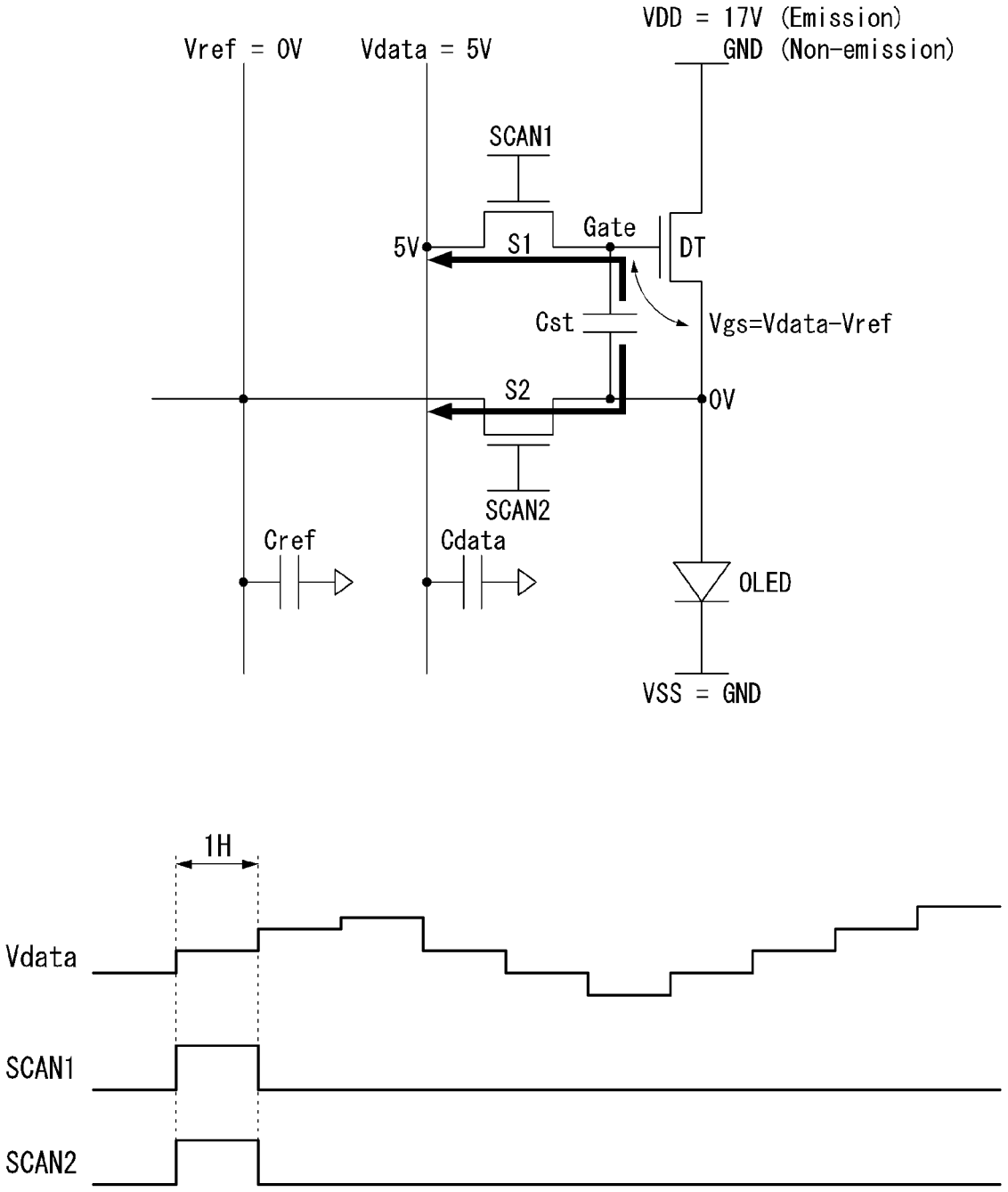
Figure 19:
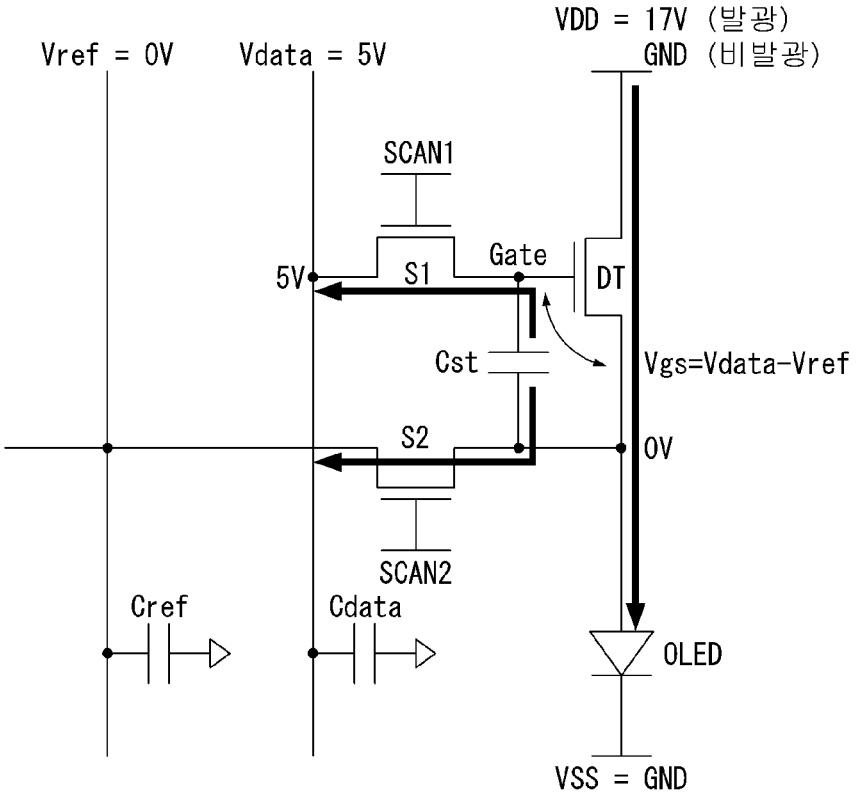

FIGS. 17 to 19 are views showing in detail how a pixel circuit operates when VDD swings.

FIG. 17 shows how a pixel circuit operates in the reset and data write step of the capacitor Cst.

Referring to FIG. 17, the driving voltage of the pixel circuit is VDD=GND, VSS=GND, and Vref=0 V in the reset and data write step of the capacitor. GND may be 0 V. In this instance, the voltages of the scan signals SCAN1 and SCAN2 may rise to VGH, and the switching elements S1 and S2 are turned on.

In the reset and data write step of the capacitor, a data voltage (Vdata=5 V) is applied to the gate of the driving element DT, and a reference voltage (Vref=0 V) is applied to the source of the driving element DT. Thus, in the reset and data write step of the capacitor, the gate-source voltage Vgs of the driving element DT is Vgs=Vdata−Vref, which is equal to the voltage of the capacitor Cst. The gate voltage Vg, source voltage Vs, the gate-source voltage Vgs and drain-source voltage Vds of the driving element DT are Vg=5 V, Vs=0 V, Vgs=5 V, and Vds=0 V.

In the reset and data write step of the capacitor, the Vgs of the driving element DT is lower than the threshold voltage Vth, whereby the driving element DT is turned off and no current flows through the driving element DT. In this instance, the source voltage of the driving element DT is Vs=Vref=0V. Thus, the Vds of the switching elements S1 and S2 is maintained at 0 V, and there is no leakage current. Also, the Vgs of the driving element DT is maintained at 5 V, and no data voltage is lost.

FIG. 18 shows the current in the pixel circuit prior to the light emission step.

Referring to FIG. 18, the driving voltage of the pixel circuit is maintained at VDD=GND, VSS=GND, and Vref=0 V. As the voltages of the scan signals SCAN1 and SCAN2 are changed to VGL, the switching elements S1 and S2 are turned off. In this case, the source voltage of the driving element DT is maintained at Vs=Vref=0 V since no current Ids flows through the driving element DT. Therefore, the Vds of the switching elements S1 and S2 is maintained at 0 V, requiring no power consumption, and the Vgs of the driving element DT is maintained at 5 V, causing no loss in data voltage.

FIG. 19 shows the current in the pixel circuit in the light emission step.

Referring to FIG. 19, VDD is changed to 17 V in the light emission step, and the driving voltage of the pixel circuit is VDD=17 V, VSS=GND=0 V, and Vref=0 V. In the light emission step, the switching elements S1 and S2 are in the off state.

In the light emission step, the voltage of the driving element DT is Vg=5 V, Vs=0 V, Vgs=5V, and Vds=17 V, and the driving element DT is turned on. Thus, through the driving element DT, the source voltage of the driving element DT, i.e., the anode voltage of the OLED, rises, and the OLED is turned on. In this instance, when the driving voltage of the OLED reaches Voled, the voltage of the driving element DT is Vg=5 V−Vx, Vs(Voled)=0 V−Vx, and Vgs=5V due to coupling through the capacitor Cst, and the OLED is turned on and emits light.

Although the switching elements S1 and S2 are in the off state in the light emission step, the Vds of the first switching element S1 is equal to (5 V+Vx)−5V and the Vds of the second switching element S2 is equal to (0 V+Vx)−0V. Thus, almost no leakage current flows.

Figure 20:
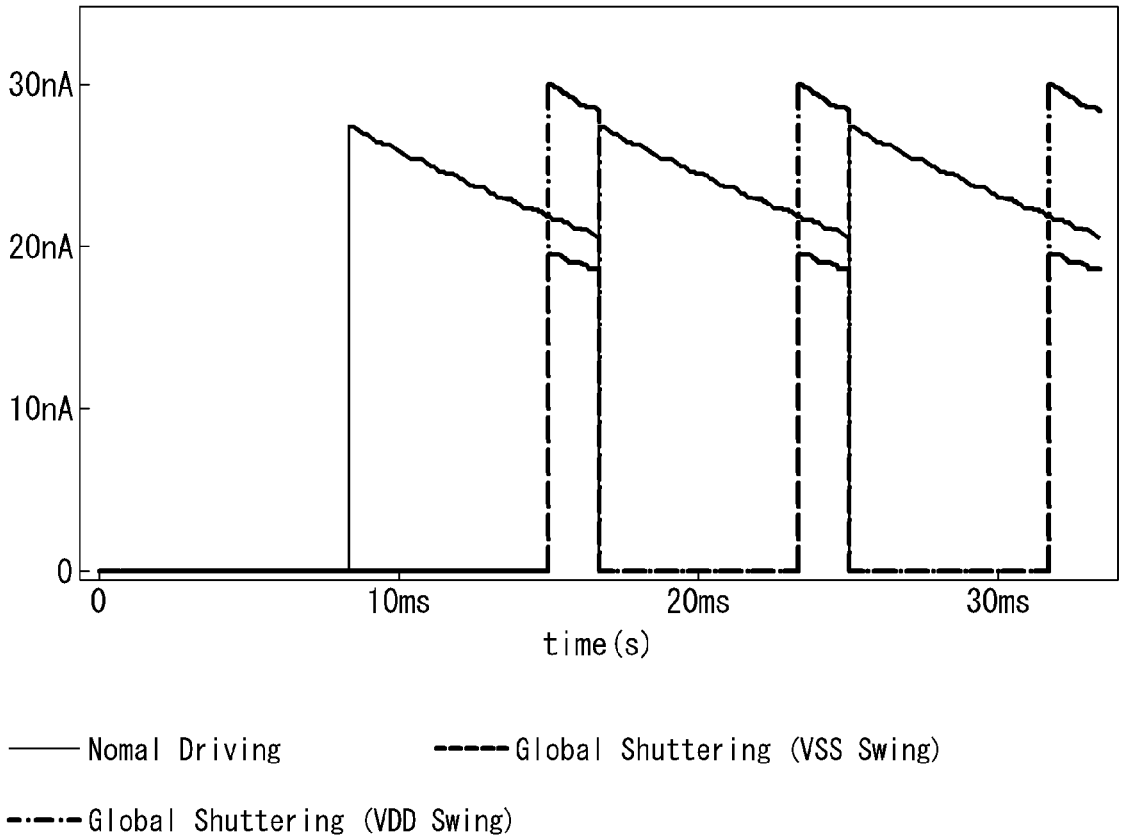
FIG. 20 is a view of the results of a simulation showing how the current in the OLED changes during the light emission period of the OLED when the OLED swings between VDD and VSS.

FIG. 20 is a view of the results of a simulation showing how the current in the OLED changes during the light emission period of the OLED when the OLED swings between VDD and VSS. In FIG. 20, the horizontal axis denotes time (ms), and the vertical axis denotes current (nA).

In FIG. 20, "Normal Driving" represents how the current in the OLED changes during the light emission period in a conventional display device in which there is no swing between VDD and VSS. "Global Shuttering (VSS Swing)" represents how the current in the OLED changes during the light emission period in a display device where the VSS applied to the cathode of the OLED swings. "Global Shuttering (VDD Swing)" represents how the current in the OLED changes during the light emission period in a display device in which the VDD applied to the anode of the OLED swings.

As can be seen from FIG. 20, the amount of current reduction in the OLED of a pixel circuit in the example where VDD swings is smaller than that in a comparative example in which VSS swings, which leads to less luminance degradation.

As discussed above, in the present disclosure, pixels may be driven through impulses across the entire screen by dividing the screen into a plurality of blocks and controlling high-level voltage VDD and low-level voltage VSS individually on a per-block basis. This may improve motion blur and also reduce EMI by distributing peak current across the blocks.

The present disclosure may prevent luminance degradation in pixels since leakage current in the pixels can be avoided by swinging the VDD applied to the pixels.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescence display, comprising:

a display panel divided by a plurality of pixel blocks and each pixel block having a plurality of pixels;

a first power line individually connected to the plurality of pixels of each pixel block and individually providing a first voltage that swings between a high level voltage and a low level voltage to each block;

a second power line individually connected to the plurality of pixels of each pixel block and individually providing a second voltage that swings between the high level voltage and the low level voltage to each block; and a switching circuit switching between the high level voltage and the low level voltage, wherein the switching circuit is connected between each block and a power supply generating the high and low level voltages.

2. The electroluminescence display according to claim 1, wherein the switching circuit comprises:

a first switching circuit switching the first voltage; and a second switching circuit switching the second voltage, wherein the first and second switching circuits switch a direction opposite to each other.

3. The electroluminescence display according to claim 1, wherein the switching circuit switches the first voltage and the second voltage at a same switching timing.

4. The electroluminescence display according to claim 1, wherein the plurality of pixel blocks includes a first pixel block and a second pixel block, and pixels in each of the first and second pixel blocks are coupled to the first power line and the second power line of the pixel blocks, and the first power line for respective pixel blocks is separated from each other and the second power line for respective pixel blocks is separated from each other.

5. The electroluminescence display according to claim 4, wherein, the switching circuit switches voltages of the plurality of pixel blocks at a same switching timing, and voltages of each pixel block includes the first voltage and the second voltage of the pixel block.

6. The electroluminescence display according to claim 4, wherein the switching circuit switches at a switching timing with respect to each of the plurality of pixel blocks, voltages of the pixel block, voltages of each pixel block including the first voltage and the second voltage of the pixel block, and the switching timing for the second pixel block has a predetermined delay with respect to the switching timing for the first pixel block.

7. The electroluminescence display according to claim 5, wherein the switching circuit switches at a switching timing with respect to each pixel block, the first voltage of the pixel block from the low level voltage to the high level voltage and the second voltage of the pixel block from high level voltage to the low level voltage, so that the pixels in the pixel block emit light, and the switching timings for respective pixel blocks are set such that emission periods of respective pixel blocks have an overlapping part in which all pixels emit light.

8. The electroluminescence display according to claim 1, further comprising a controller controlling switching timing of the switching circuit.

9. The electroluminescence display according to claim 8, wherein the controller provides, to the switching circuit, a first switching signal for switching of the first voltage and a second switching signal for switching of the second voltage, and the first switching signal has an opposite phase to the second switching signal.

10. The electroluminescence display according to claim 9, wherein the plurality of pixels are divided into a plurality of pixel blocks including a first pixel block and a second pixel block, and pixels in each of the pixel blocks are coupled to the first power line and the second power line of the pixel block, wherein each first power line for respective pixels blocks is separated from each other and each second power line for respective pixels blocks is separated from each other, and the controller provides, to each of the plurality of pixel blocks, the first switching signal and the second switching signal for this pixel block respectively.

11. The electroluminescence display according to claim 10, wherein the switching timing for the first switching signal and the second switching signal of the first pixel block is the same as the switching timing for the first switching signal and the second switching signal of the second pixel block.

12. The electroluminescence display according to claim 10, wherein the switching timing for the first switching signal and the second switching signal of the second pixel block has a predetermined delay with respect to the switching timing for the first switching signal and the second switching signal of the first pixel block.

13. The electroluminescence display according to claim 1, wherein the switching circuit switches the first voltage to the high level voltage and switches the second voltage to the low level voltage during a vertical blanking interval where no pixel data is input.

14. The electroluminescence display according to claim 1, wherein, each pixel comprises a plurality of subpixels with different colors, and each subpixel comprising:

a light-emitting element having a cathode coupled to the second power line of the pixel;

a driving element having a drain coupled to the first power line of the pixel, and driving the light-emitting element;

a first switching element turned on in response to a first gate signal synchronized with a data voltage and supplying the data voltage to a gate of the driving element;

a second switching element turned on in response to a second gate signal and supplying a predetermined reference voltage to a source of the driving element and an anode of the light-emitting element; and a capacitor disposed between the gate and source of the driving element.

15. An electroluminescence display, comprising:

a plurality of blocks, each of which including a plurality of pixels;

first and second power lines individually connected to each of the plurality of blocks; and switching circuits switching voltages on the plurality of power lines of each block between a high level voltage and a low level voltage, wherein the switching circuit is connected between each block and a power supply generating the high and low level voltages, the first power line individually transmits a first voltage that swings between a high level voltage and a low level voltage to each block, and the second power line individually transmits a second voltage that swings between the high level voltage and the low level voltage to each block.

16. The electroluminescence display according to claim 15, wherein the switching circuits switch the voltages on the plurality of power lines of respective blocks simultaneously.

17. The electroluminescence display according to claim 15, wherein the switching circuits switch the voltages on the plurality of power lines of respective blocks sequentially block by block.

18. The electroluminescence display according to claim 17, wherein the switching circuits switch the voltages on the plurality of power lines of respective block, such that during an impulse driving period, pixels in all blocks emit light simultaneously.

19. The electroluminescence display according to claim 15, wherein, for each of the plurality of blocks, a first power line and a second power line are coupled to the plurality of pixels in each block, a first switching circuit switches voltage on the first power line, and a second switching circuit switches voltage on the second power line, wherein the first switching circuit switches a direction opposite to the second switching circuit, at a same timing.

20. The electroluminescence display according to claim 19, wherein, for each of the plurality of blocks, when the first power line is at the high level voltage and the second power line is at the low level voltage, and the pixels in the block emit light.

* * * * *